US011058603B2

(12) United States Patent
Chen et al.

(10) Patent No.: US 11,058,603 B2
(45) Date of Patent: Jul. 13, 2021

(54) MATTRESS SYSTEM

(71) Applicant: SHL Group AB, Nacka Strand (SE)

(72) Inventors: Hsueh-Yi Chen, Lujhou (TW); Wen-Hung Feng, Pingzhen (TW); Shih-Hsun Tu, Taoyuan (TW)

(73) Assignee: SHL HEALTHCARE AB, Nacka Strand (SE)

( * ) Notice: Subject to any disclaimer, the term of this patent is extended or adjusted under 35 U.S.C. 154(b) by 862 days.

(21) Appl. No.: 15/835,168

(22) Filed: Dec. 7, 2017

(65) Prior Publication Data

US 2018/0153766 A1 Jun. 7, 2018

Related U.S. Application Data

(62) Division of application No. 14/356,154, filed as application No. PCT/SE2012/051146 on Oct. 24, 2012, now abandoned.

(Continued)

(30) Foreign Application Priority Data

Nov. 3, 2011 (SE) ..... 1151037-7

(51) Int. Cl.

| | |
|---|---|
| ***A61G 7/018*** | (2006.01) |
| ***A61H 31/00*** | (2006.01) |
| ***A61G 7/057*** | (2006.01) |

(52) U.S. Cl.

CPC ..... *A61H 31/008* (2013.01); *A61G 7/05776* (2013.01); *A61G 7/05792* (2016.11); *A61G 7/018* (2013.01)

(58) Field of Classification Search

CPC ..... A61G 7/05784; A61G 7/05769; A61G 7/018; A61G 7/05776

See application file for complete search history.

(56) References Cited

U.S. PATENT DOCUMENTS 5,051,673 A * 9/1991 Goodwin ..... A61G 7/05776 318/481
5,109,560 A * 5/1992 Uetake ..... A61G 7/05784 5/713

(Continued)

FOREIGN PATENT DOCUMENTS

CA 2567951 A1 5/2008
EP 0168213 A2 1/1986

(Continued)

OTHER PUBLICATIONS

Sweden Patent Office, Int'l Search Report in PCT/SE2012/051146, dated Jan. 30, 2013.

(Continued)

*Primary Examiner* — Peter M. Cuomo
*Assistant Examiner* — Ifeolu A Adeboyejo
(74) *Attorney, Agent, or Firm* — McDonnell Boehnen Hulbert & Berghoff LLP

(57) ABSTRACT

The present invention provides a mattress system (1) devised to achieve a function of automatic detection, mainly comprising: a mattress (2) having a simple structure; a control unit (3) equipped with a unique user interface (31) for caregivers to simultaneously adjust three major functions, namely, therapy mode, therapy intensity and comfort level; and a connection pipe (4) for supplying air and power. The system (1) is further provided with a built-in auto-setting function to sense the body characteristics of the patient (39) lying on the mattress (2) and determine an effective supporting pressure range for the patient (39). By detecting a pressure difference representing the body characteristics of the patient (39) lying on the mattress (2) and comparing with the data stored in a built-in database, the system (1) can always provide the patient (39) with not only a well-proved therapeutic effect through the auto-setting (Continued)

function, but also an adjustable comfort level on the patient's request through the user interface (31).

15 Claims, 18 Drawing Sheets

Related U.S. Application Data

(60) Provisional application No. 61/555,238, filed on Nov. 3, 2011.

(56) References Cited

U.S. PATENT DOCUMENTS 5,493,742 A * 2/1996 Klearman ..... A47C 27/082 5/423
5,586,346 A 12/1996 Stacy et al.
5,701,622 A 12/1997 Biggie et al.
5,882,349 A * 3/1999 Wilkerson ..... A47C 27/006 5/423
5,926,884 A * 7/1999 Biggie ..... A61G 7/05776 297/180.13
6,487,739 B1 * 12/2002 Harker ..... A61G 7/05707 5/423
6,877,178 B2 4/2005 Chapman et al.
6,928,681 B1 8/2005 Stacy
7,914,611 B2 3/2011 Vrzalik et al.
7,975,331 B2 * 7/2011 Flocard ..... A61G 7/05784 5/423
7,975,335 B2 * 7/2011 O'Keefe ..... A61G 7/05784 5/616
8,220,090 B2 * 7/2012 Gowda ..... A61G 7/05784 5/713
9,030,331 B2 * 5/2015 Lachenbruch ..... A61G 7/05776 340/665
9,131,781 B2 * 9/2015 Zaiss ..... A47C 21/044
2001/0039681 A1 11/2001 Johnson et al.
2002/0066143 A1 * 6/2002 Graebe ..... A47C 23/002 5/710
2002/0129448 A1 * 9/2002 Pirzada ..... A47C 27/18 5/713
2003/0182728 A1 10/2003 Chapman et al.
2004/0031103 A1 * 2/2004 Wyatt ..... A47C 27/088 5/710
2004/0226103 A1 11/2004 Reger et al.
2004/0255386 A1 * 12/2004 Liu ..... A61G 7/05776 5/710
2006/0179579 A1 8/2006 Phillips et al.
2007/0261548 A1 11/2007 Vrzalik et al.
2007/0266499 A1 * 11/2007 O'Keefe ..... A61G 7/05784 5/713
2008/0028533 A1 * 2/2008 Stacy ..... A61G 7/015 5/713
2008/0098532 A1 5/2008 Gowda
2008/0109964 A1 5/2008 Flocard et al.
2008/0155755 A1 * 7/2008 Crousore ..... A61G 7/015 5/706
2008/0235872 A1 * 10/2008 Newkirk ..... G06F 3/0481 5/600
2008/0307582 A1 12/2008 Flocard et al.
2010/0071130 A1 3/2010 Frias
2010/0101026 A1 * 4/2010 Papaioannou ..... G05D 16/20 5/710
2010/0212089 A1 8/2010 Kajiwara et al.
2011/0197366 A1 * 8/2011 Lachenbruch ..... A61G 7/05776 5/655.3
2011/0308020 A1 * 12/2011 Vrzalik ..... A47C 21/042 5/724
2012/0317727 A1 * 12/2012 Tanaka ..... A47C 27/10 5/710
2013/0067661 A1 * 3/2013 Schwirian ..... B01D 53/04 5/600
2013/0283530 A1 * 10/2013 Main ..... A47C 27/083 5/600
2014/0000040 A1 * 1/2014 Caminade ..... A61G 7/05776 5/713
2015/0000044 A1 * 1/2015 Morimura ..... A61G 7/05776 5/710
2015/0013073 A1 * 1/2015 Schwirian ..... A61G 7/05769 5/706
2015/0040326 A1 * 2/2015 Fairburn ..... A61G 7/05776 5/713

FOREIGN PATENT DOCUMENTS

EP 2298264 A2 3/2011
FR 2884708 A1 10/2006
TW 201117139 A 5/2011
WO 2006/023479 A2 3/2006
WO 2009/044201 A1 4/2009
WO 2011/096115 A1 8/2011
WO 2013/066247 A1 5/2013

OTHER PUBLICATIONS

Sweden Patent Office, Written Opinion in PCT/SE2012/051146, dated Jan. 30, 2013.

* cited by examiner

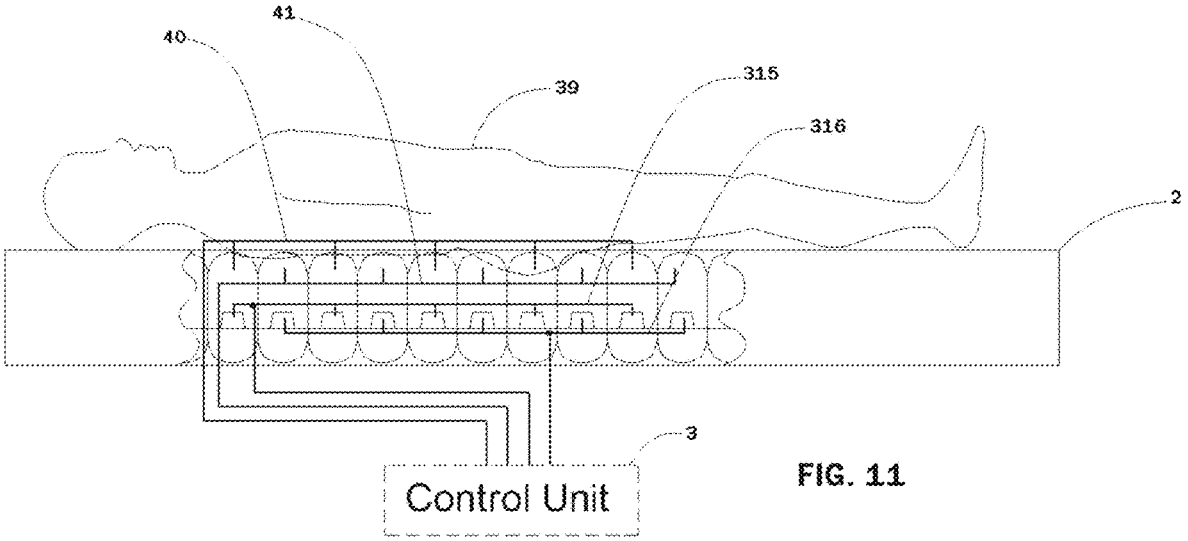
FIG. 11
FIG. 12
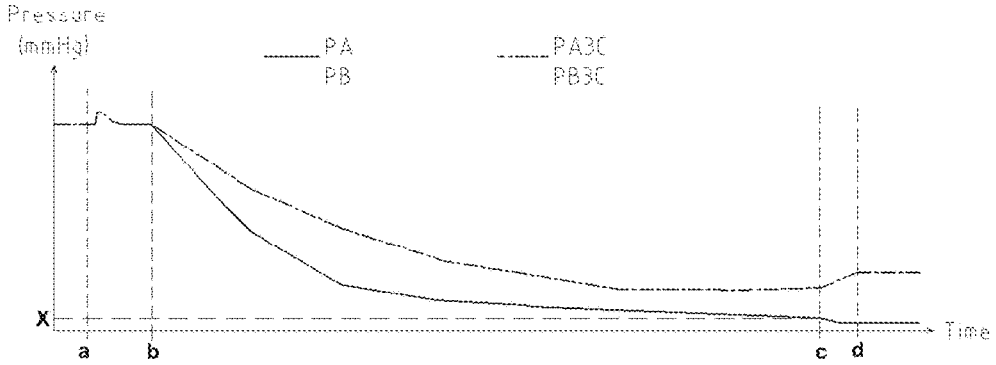

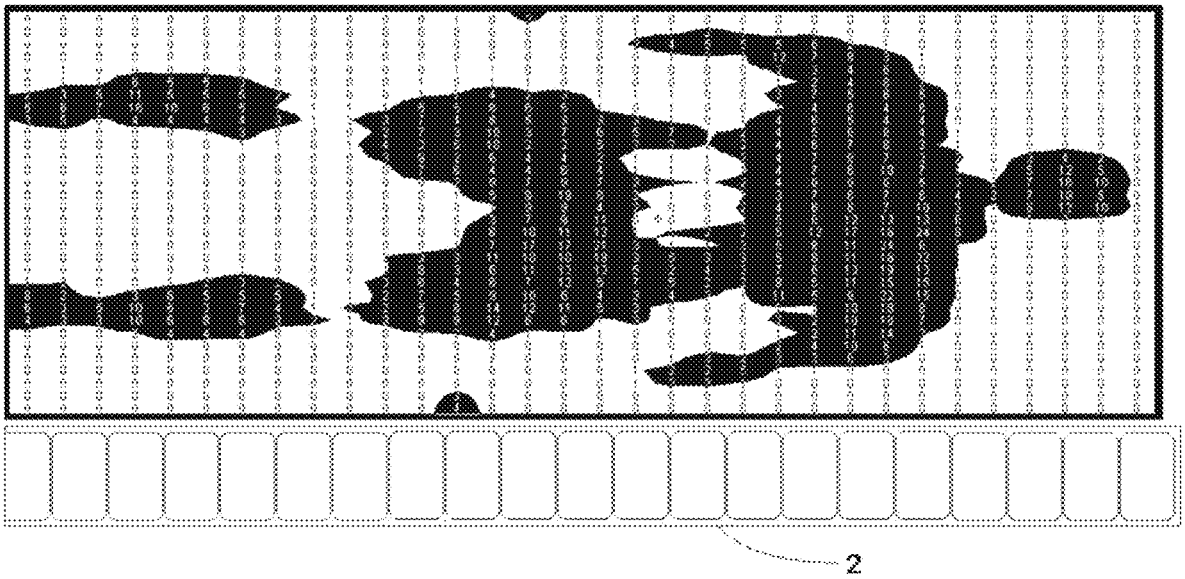
| Patient | Sex | Height (CM) | Weight (Kg) | BMI | X(mmHg) | Interface Pressure < 32mmHg |
|---|---|---|---|---|---|---|
| Patient A | Female | 158 | 45 | 18.0 | 6.5 | Y |
| Patient B | Male | 176 | 68 | 22.0 | 7.2 | Y |
| Patient C | Male | 180 | 80 | 24.7 | 8.9 | Y |
| Patient D | Male | 176 | 105 | 33.9 | 13 | Y |
FIG. 13
FIG. 14
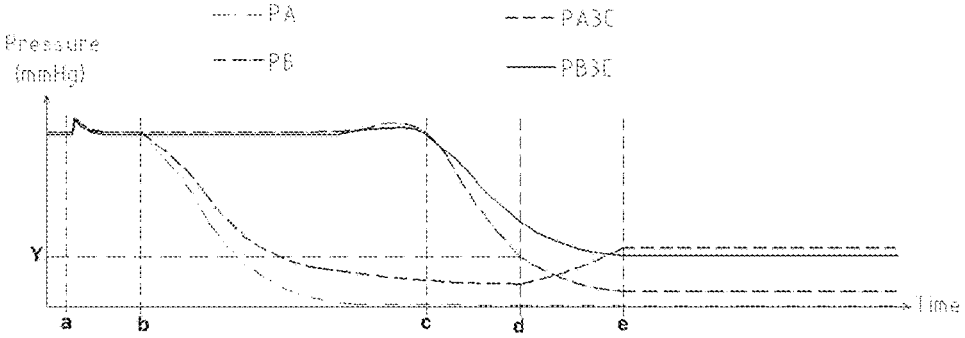

| Patient | Sex | Height (CM) | Weight (Kg) | BMI | Y(mmHg) | Pressure Released |
|---|---|---|---|---|---|---|
| Patient A | Female | 158 | 45 | 18.0 | 28 | Y |
| Patient B | Male | 176 | 68 | 22.0 | 30 | Y |
| Patient C | Male | 180 | 80 | 24.7 | 33 | Y |
| Patient D | Male | 176 | 105 | 33.9 | 44 | Y |

Static Database :

| Static Interface Pressure | ΔP | | | | | | | | | |
|---|---|---|---|---|---|---|---|---|---|---|
| System Pressure | 2 | 4 | 6 | 8 | 10 | 12 | 14 | 16 | 18 | 20 |
| 4 | 6 | 6 | 80 | 80 | 80 | 80 | 80 | 80 | 80 | 80 |
| 8 | 9 | 9 | 8 | 8 | 10 | 10 | 80 | 80 | 80 | 80 |
| 12 | 12 | 12 | 12 | 12 | 13 | 13 | 12 | 12 | 12 | 12 |
| 16 | 15 | 15 | 15 | 15 | 16 | 16 | 17 | 17 | 17 | 17 |
| 20 | 18 | 18 | 18 | 18 | 19 | 19 | 22 | 22 | 22 | 22 |
| 24 | 20 | 20 | 21 | 21 | 22 | 22 | 25 | 25 | 25 | 25 |
| 28 | 22 | 22 | 25 | 25 | 25 | 25 | 29 | 29 | 29 | 29 |
| 32 | 25 | 25 | 29 | 29 | 29 | 29 | 32 | 32 | 32 | 32 |
| 36 | 28 | 28 | 32 | 32 | 32 | 32 | | | | |
| 40 | 30 | 30 | | | | | | | | |

286

284

287

285

288

FIG. 18

Alternating Database :

| Alternating Interface Pressure | ΔP | | | | | | | | | |
|---|---|---|---|---|---|---|---|---|---|---|
| System Pressure | 2 | 4 | 6 | 8 | 10 | 12 | 14 | 16 | 18 | 20 |
| 4 | 12 | 12 | 12 | 15 | 15 | 15 | 18 | 18 | 24 | 24 |
| 8 | 11 | 11 | 11 | 12 | 12 | 12 | 15 | 15 | 18 | 18 |
| 12 | 9 | 9 | 9 | 11 | 11 | 11 | 12 | 12 | 15 | 15 |
| 16 | 7 | 7 | 7 | 9 | 9 | 9 | 11 | 11 | 12 | 12 |
| 20 | 7 | 7 | 7 | 7 | 7 | 7 | 9 | 9 | 11 | 11 |
| 24 | 4 | 4 | 4 | 7 | 7 | 7 | 7 | 7 | 9 | 9 |
| 28 | 1 | 1 | 1 | 4 | 4 | 4 | 4 | 4 | 7 | 7 |
| 32 | 1 | 1 | 1 | 1 | 1 | 1 | 1 | 1 | 4 | 4 |
| 36 | 0 | 0 | 0 | 0 | 0 | 0 | 1 | 1 | 1 | 1 |
| 40 | 0 | 0 | 0 | 0 | 0 | 0 | 0 | 0 | 0 | 0 |

295

293

296

294

FIG. 19

MATTRESS SYSTEM

FIELD OF THE INVENTION

The present invention relates to a mattress system for medical treatment, and more particularly, to a mattress system provided with an auto-setting process so as to achieve a function of automatic detection of the body characteristics of a patient lying on the mattress.

DESCRIPTION OF RELATED ART

A mattress system for medical treatment is mainly used for the prevention and treatment of pressure ulcers. The mattress system normally consists of an air pressure source connected to a mattress formed with a series of air cells arranged inside through pipelines, and a pressure sensor for detecting pressure in each zone of the mattress. The pressure level in each zone of the mattress is regulated by controlling dispensing valves through the air pressure source and a controller so as to provide a good blood circulation for a patient lying on the mattress, prevent a portion of the patient's body to be treated being continuously compressed, and supply a suitable pressure to the patient.

Regarding the mattress system for medical treatment, there are three kinds of mattress systems so far, namely, a manual manipulation mattress system, a semi-automated mattress system, and a fully automated mattress system. Some of the conventional mattress systems are briefly illustrated as follows.

U.S. Pat. No. 6,928,681 discloses a semi-automated mattress system utilizing an air channel sensor pad that passively senses bottoming out of a patient and increases system pressure at a pre-determined rate. However, limitations of the U.S. Pat. No. 6,928,681 are that a constant loss of air from the mattress system and a continuous operation of a compressor with a higher capacity, which increase the rate of aging and the risk of a malfunction of the compressor. Therefore, a second compressor is required to circulate the air through the sensor pad. In addition, the mattress system of the U.S. Pat. No. 6,928,681 is a passive reaction device that requires trained operators to set initial pressure settings before use and to adjust the supporting pressure level from a response of the sensor pad. An alternating pressure therapy requires a higher supporting pressure to intensify the reactive hyperemia in a deflated zone. Placing the sensor pad under the mattress will cause the response of the sensor pad to be not sharp enough. By the time when the response is received from the sensor pad, the pressure in the mattress is too low to efficiently support the patient in order to have a therapeutic effect. Another disadvantage is that the mattress system requires more additional components, which greatly increases the manufacture cost and the risk of the malfunction of the additional components. There is still another disadvantage that the mattress system only provides an alternating mode with respect to the system therapy modes, which causes that the therapeutic effect, is inferior.

U.S. Pat. No. 6,877,178 discloses a fully automated mattress system utilizing an air channel sensor pad which sets the system pressure based on the flow rate of fluid exhausted from the sensor pad. By controlling an output of a compressor based on the flow rate of the fluid exhausted from the sensor pad, the mattress system of the U.S. Pat. No. 6,877,178 eliminates the requirement of a maximum compressor output at all time and the need of a second compressor. However, a constant bleeding of fluid from the sensor pad, which causes a waste of energy, and a challenge in the lifetime and the risk of a malfunction of the compressor are still required. An extended use of the sensor pad to cover the entire mattress allows the control to the head and leg zones, but the requirement of additional components causes a higher manufacture cost and increases the risk of the malfunction of the additional components. Moreover, the mattress system only provides an alternating mode with respect to the system therapy modes, and thus the therapeutic effect is inferior.

C.A. Patent No. 2 567 951 discloses a fully automated mattress system utilizing a silicon filled pressure sensing pad to measure and interpret the optimum system pressure. However, the mattress system of the C.A. Patent No. 2 567 951 is complicated since additional electrical components are integrated into the mattress, which increases the risk of electrical hazards to the patient lying on the mattress. The additional components also increase the manufacture cost and the risk of the malfunction of the additional components. Further, the system therapy modes of the mattress system are accomplished by using two different user panels, in which one is provided for the static therapy mode and the other is provided for the alternating therapy mode. However, the mattress system is inconvenient in use due to a need of switching between these two user panels and is complicated in operation for a caregiver and a patient required for treatment.

SUMMARY OF THE INVENTION

In view of the shortcomings of the conventional mattress systems described in the above, an object of the present invention is to provide a mattress system having a simple structure and utilizing a unique user interface such as a turning knob mounted on a control unit to adjust three major system functions (namely, therapy mode, therapy intensity level, and comfort level) at the same time. The mattress system in accordance with the present invention is further provided with an auto-setting process, which is a requisite for the mattress system and used to detect body characteristics of a patient lying on the mattress and determine an effective supporting pressure range for the patient, such that the mattress system can always provide the patient not only a suitable therapeutic pressure support, but also an adjustable comfort feeling.

The present invention provides a mattress system comprising: a mattress adapted to provide a function of pressure supporting for a patient lying on the mattress; a control unit adapted to control inflation and deflation of the mattress; and a connection pipe provided between the mattress and the control unit to supply air and power, characterized in that the control unit is equipped with an user interface for allowing a caregiver to simultaneously adjust system functions and a controller provided with a pre-programmed auto-setting process for conducting an auto-setting function to sense body characteristics of the patient and determine a therapeutic effective supporting pressure range to support the patient on the mattress, whereby not only an effective therapeutic pressure support, but also an adjustable range of comfort feeling can be provided to the patient through a combination of the user interface and the auto-setting function.

There is provided a mattress system in accordance with the present invention, wherein the mattress comprises an upper inflatable bladder layer, a lower inflatable bladder layer positioned under the upper inflatable bladder layer, and a plurality of air cells each having an upper portion located in the upper inflatable bladder layer and a lower portion located in the lower inflatable bladder layer.

There is provided a mattress system in accordance with the present invention, wherein the plurality of air cells are arranged in a longitudinal direction and separated into a plurality of zones, wherein the air cells in each zone are fluidly interconnected with each other.

There is provided a mattress system in accordance with the present invention, wherein the plurality of air cells in the upper inflatable bladder layer (35) is separated into a head-section zone, a body-section zone and a leg-section zone.

There is provided a mattress system in accordance with the present invention, wherein the air cells in the body-section zone is further separated into a first group of air cells and a second group of air cells, and the first group of air cells and the second group of air cells are alternatively arranged in the longitudinal direction, wherein the air cells within each group are fluidly interconnected with each other and regulated to a certain target pressure level for one of the system functions set through the control unit.

There is provided a mattress system in accordance with the present invention, wherein the system functions include at least a comfort level, a therapy mode and a therapy intensity level.

There is provided a mattress system in accordance with the present invention, wherein the therapy modes at least include a static therapy mode, a pulsation therapy mode, and an alternating therapy mode.

There is provided a mattress system in accordance with the present invention, wherein an operation process is respectively performed in the therapy mode so as to obtain a lowest supporting pressure required for the patient whose body characteristics have been sensed in the static therapy mode, and a lowest inflated supporting pressure required for the patient whose body characteristics have been sensed in the alternating therapy mode, such that a promised therapeutic effect can be achieved.

There is provided a mattress system in accordance with the present invention, wherein the user interface is a single turning knob or any other continuous adjusting input means.

There is provided a mattress system in accordance with the present invention, wherein the auto-setting function is implemented by using a three-chamber structure in the air cells of the body-section zone, wherein each of the three-chamber air cells is comprised of an upper bladder chamber, an air sensing chamber, and a lower bladder chamber, with the air sensing chamber positioned at a bottom portion of the upper bladder chamber.

There is provided a mattress system in accordance with the present invention, wherein the three-chamber air cells in the body-section zone are used to detect the lowest therapeutic pressures of the upper bladder chamber in the static and alternating therapy modes.

There is provided a mattress system in accordance with the present invention, wherein the auto-setting process is implemented by using pre-programmed databases including a pre-programmed static database and a pre-programmed alternating database containing a series of values of the actual experimental interface pressure of the patients with respect to different values of the pressure difference $\Delta P$, under different system pressure settings.

There is provided a mattress system in accordance with the present invention, wherein the pre-programmed static database is used when the mattress system is operating in the static therapy mode, and the pre-programmed alternating database is used when the mattress system is operating in the alternating therapy mode, to obtain a range of values of the therapeutic system pressure.

There is provided a mattress system in accordance with the present invention, further comprising a cardio pulmonary resuscitation (CPR) assembly connected with each of the head-section zone, the body-section zone, the leg-section zone, and the lower bladder layer through a plurality of pneumatic hoses, and manually switched between an exhaust state and a sealed state.

There is provided a mattress system in accordance with the present invention, wherein the CPR assembly is initially set in the sealed state and the air in each zone is blocked from leaking to an external atmosphere, and when the CPR assembly is switched to the exhaust state, each zone is opened to the external atmosphere, and the air in each zone will be exhausted rapidly through the CPR assembly.

There is provided a mattress system in accordance with the present invention, wherein the CPR assembly further comprises a sensing pipe through which pressurized air is supplied from a compressor as an air source, and the pressure level of the pressurized air in the CPR sensing pipes is measured and monitored by a pressure sensor provided in the controller of the control unit, wherein when the CPR assembly is switched to the exhaust state, the controller will detect that the air pressure in the CPR sensing pipe is decreasing, and the compressor is turned off by the controller and then all of the valves are changed to the exhaust state, such that a CPR indicator provided on the user interface is turned on.

There is provided a mattress system in accordance with the present invention, further comprising an active coverlet provided to be covered on the mattress as an interface between the patient's body and the mattress so as to control the removal of excessive heat and moisture from a contact surface between the patient's body and the mattress.

There is provided a mattress system in accordance with the present invention, wherein the active coverlet is mainly made up of a fan assembly, a plurality of air pipes, and a coverlet body, wherein the coverlet body is divided into three regions respectively corresponding to the head-section zone, the body-section zone and the leg-section zone of the mattress with weld lines, wherein two air inlet ports are welded on one side of the coverlet body and connected to an air distributor of the control unit via the plurality of air pipes such that the air is exhausted from the air cells through the pneumatic pipes and distributed into the coverlet body through the air inlet ports when the mattress system is operating in a certain therapy mode, and wherein a fan in the fan assembly vacuums the air out of the coverlet body to external atmosphere.

There is provided a mattress system in accordance with the present invention, wherein the vacuum fan operation performed by the fan is periodically controlled by the controller based on the therapy status and the cycle time, such that once the bladder layers of the mattress start to be deflated, the fan starts to operate to efficiently remove the air exhausted from the deflating air cells and the moisture and the heat from the patient's body, and the exhausted air is discharged to the active coverlet at the same time.

There is provided a mattress system in accordance with the present invention, wherein the coverlet body in a region corresponding to the body-section zone of the mattress consists of a top layer, a middle layer and a bottom layer so as to achieve a function of transferring the moisture and heat from the patient's body to outside.

There is provided a mattress system in accordance with the present invention, wherein the top layer has a property of water impermeability and vapor permeability, the middle layer is water and vapor permeable, and the bottom layer is water and vapor impermeable and can be used to isolate the moisture from the air cells of the body-section zone of the mattress.

There is provided a mattress system in accordance with the present invention, wherein the middle layer formed with a three-dimensional porous structure is placed within an enclosure as an air channel to allow the air to be flowed within the enclosure, and has a good elasticity under compression.

BRIEF DESCRIPTION OF THE DRAWINGS

The accompanying drawings, which are incorporated in and constitute a part of this specification, illustrate a preferred embodiment of the invention and, together with a general description of the invention given above, and the detailed description of the embodiment given below, serve to explain the principle of the invention, in which:

FIG. 11 is a schematic cross-sectional view of the mattress when the air cell is implemented by using a three-chamber structure in the body-section zone of the mattress in accordance with the present invention;

FIG. 12 is a graph showing the change of the pressure over time in each of the first group of air cells, each of the second group of air cells, each of the first group of air sensing chambers, and each of the second group of air sensing chambers when the system is go through an auto-setting process implemented with a three-chamber structure to determine the static system pressure;

FIG. 13 illustrates an experimental result showing the values of the interface pressure between the patient and the mattress obtained by using the Innovative Pressure Mapping Solutions when the system is operating in the static mode and going through the auto-setting process implemented with a three-chamber structure;

FIG. 14 is a graph showing the change of the pressure over time in each of the first group of air cells, each of the second group of air cells, each of the first group of air sensing chambers, and each of the second group of air sensing chambers when the system is go through an auto-setting process implemented with a three-chamber structure to determine the alternating system pressure;

FIG. 18 shows the static database used when the system is operating in the static mode;

FIG. 19 shows the alternating database used when the system is operating in the alternating mode.

DETAILED DESCRIPTION OF PREFERRED EMBODIMENTS

Embodiments in accordance with the present invention will be described hereinafter with reference to the accompanying drawings by exemplifying a mattress system.

Figure 1:
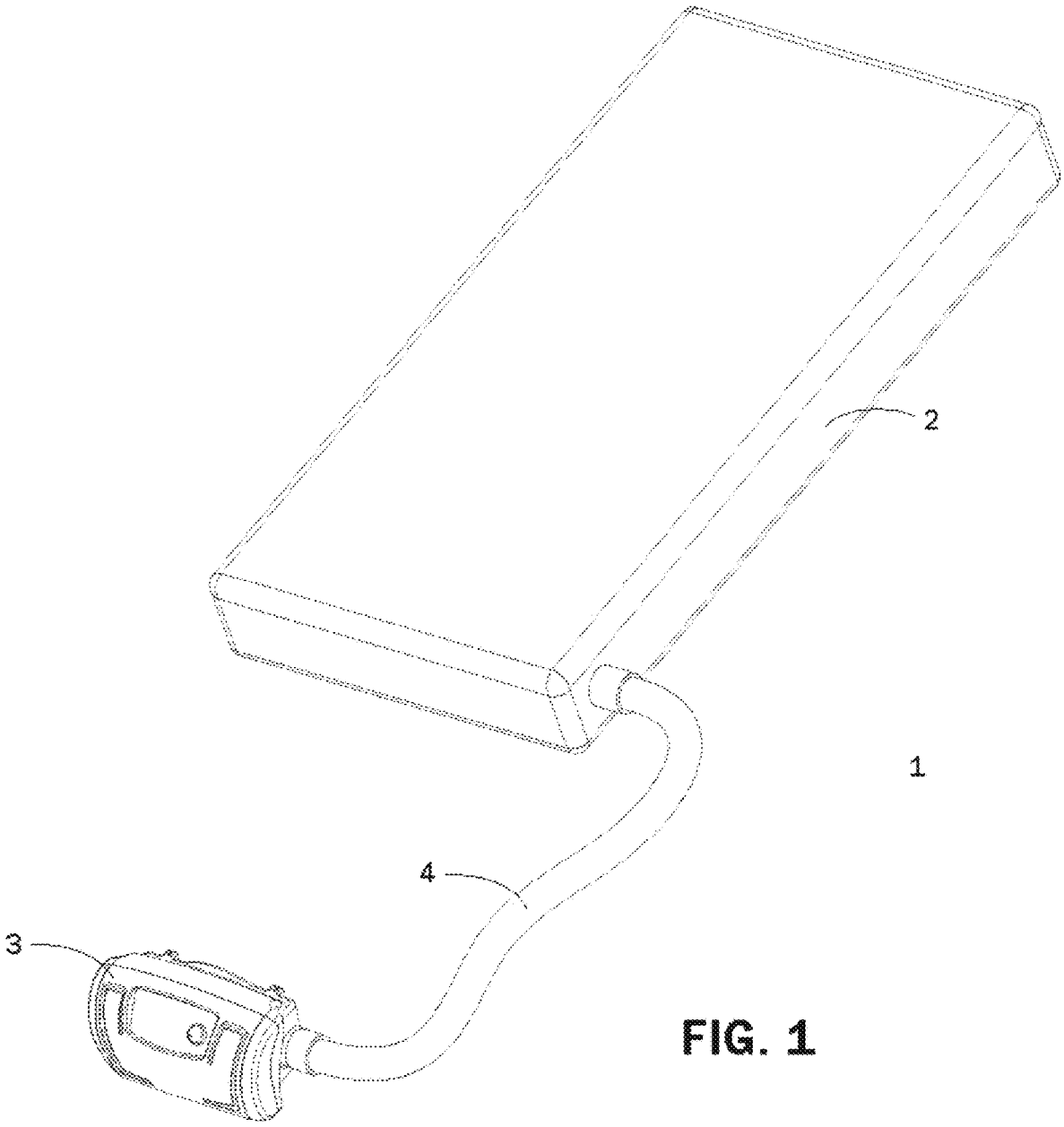
FIG. 1 shows a configuration of the mattress system in accordance with an embodiment of the present invention.

With reference to FIG. 1, a configuration of the mattress system 1 in accordance with an embodiment of the present invention is explained below.

FIG. 1 is a schematic perspective view of the mattress system 1 in accordance with an embodiment of the present invention.

As shown in FIG. 1, the mattress system 1 comprises a mattress 2 used to provide a function of pressure supporting for a patient, a control unit 3 used to control inflation and deflation of the mattress 2, and a connection pipe 4 provided between the mattress 2 and the control unit 3 to supply air and power.

The control unit 3 is equipped with a user interface 31 (to be described later) such that a caregiver can make a continuous integral adjustment in an aspect of comfort level (also referred to as an effective supporting pressure level), therapy mode and therapy intensity level for a patient. The mattress system 1 is particularly provided with an auto-setting function to sense body characteristics of a patient lying on the mattress 2, and to determine the therapeutic effective supporting pressure level to support the patient on the mattress 2. Therefore, the mattress system 1 can always provide the patient not only a well-proved therapeutic effect through the auto-setting function, but also an adjustable comfort level upon the patient's request via the user interface 31.

Figure 2:
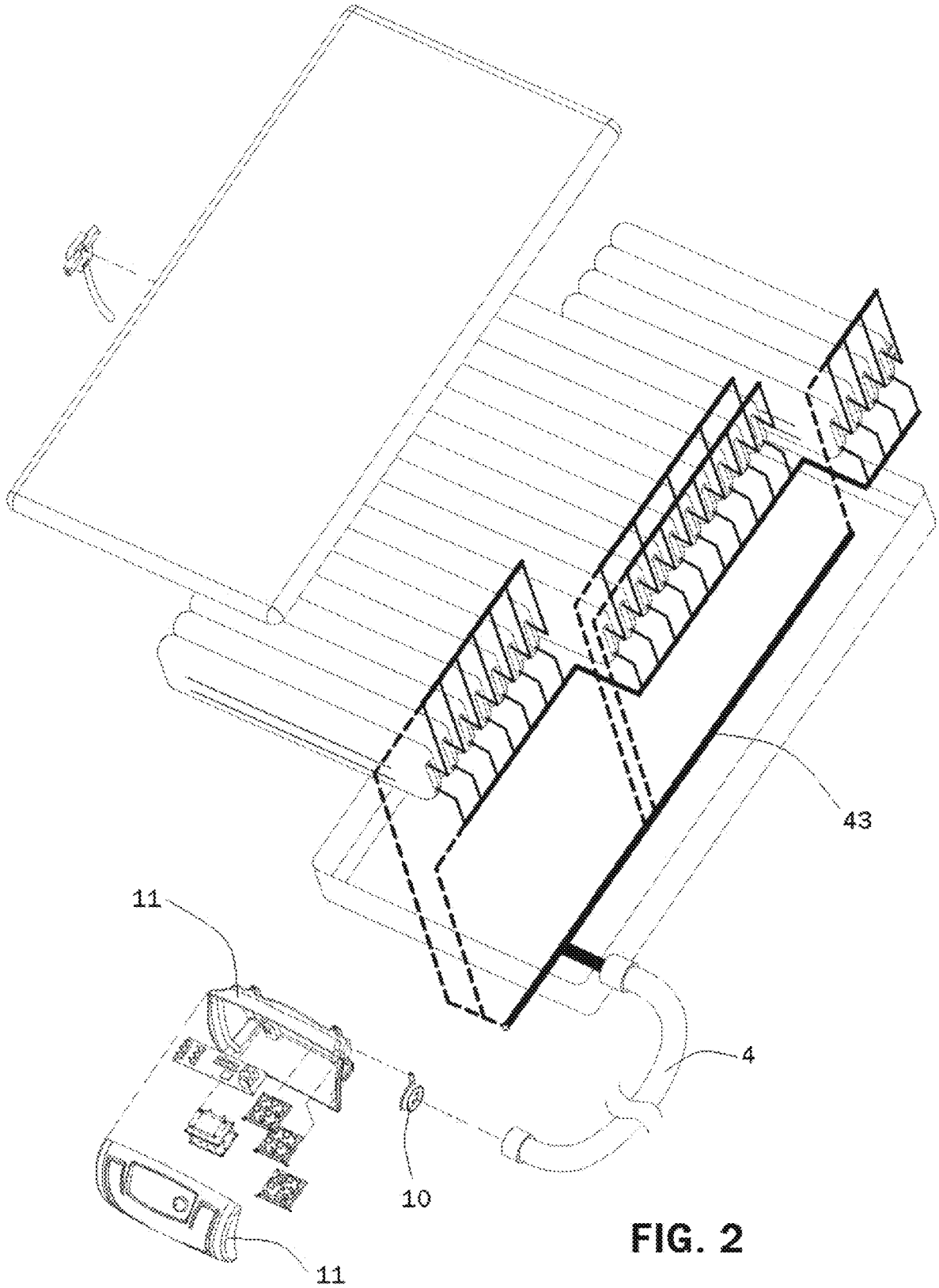
FIG. 2 is a schematic exploded view of the mattress system shown in FIG. 1.

FIG. 2 is a schematic exploded view of the mattress system 1 shown in FIG. 1.

Figure 3:
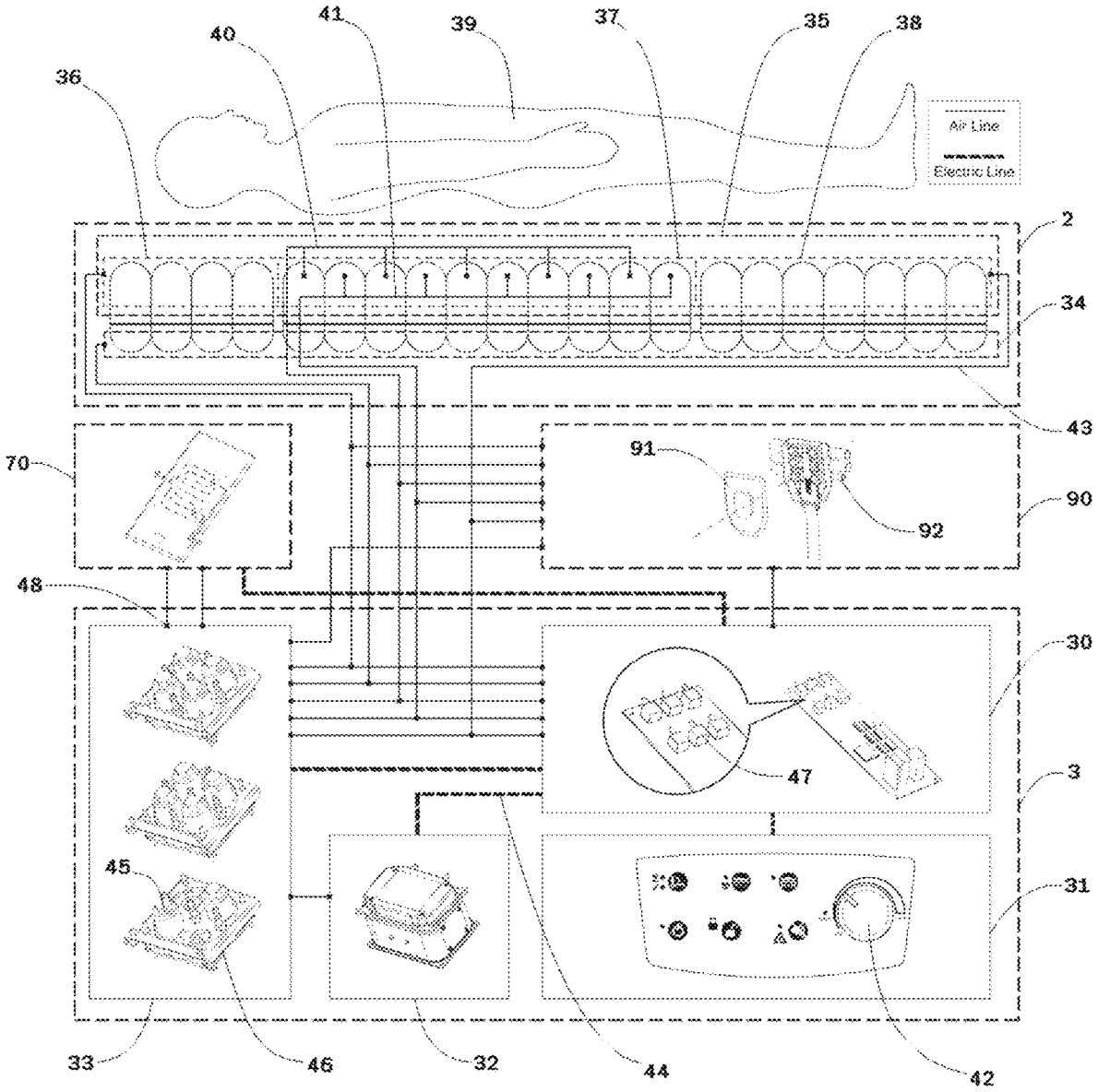
FIG. 3 is a schematic cross-sectional view of the mattress in connection with the other components of the mattress system in accordance with an embodiment of the present invention.

FIG. 3 is a schematic cross-sectional view of the mattress 2 in connection with the other components of the mattress system 1 in accordance with an embodiment of the present invention.

The components of the mattress system 1 are further described below with reference to FIGS. 1 to 3.

Mattress

Referring to FIG. 3, the mattress 2 in accordance with the present invention comprises an upper inflatable bladder layer 35, a lower inflatable bladder layer 34 positioned under the upper inflatable bladder layer 35, and a plurality of air cells each having an upper portion located in the upper inflatable bladder layer 35 (hereinafter referred to as the air cells of the upper inflatable bladder layer 35) and a lower portion located in the lower inflatable bladder layer 34 (hereinafter referred to as the air cells of the lower inflatable bladder layer 34). In this embodiment, there are 21 air cells in the mattress 2. As shown in FIG. 3, the air cells of the upper inflatable bladder layer 35 are arranged in a longitudinal direction and form a plurality of zones. In this embodiment, the air cells of the upper inflatable bladder layer 35 are grouped into three zones, namely, a head-section zone 36, a body-section zone 37, and a leg-section zone 38. The head-section zone 36 is made up of the first four air cells of the upper layer 35, which are fluidly interconnected with each other and regulated to a same pressure level. The middle ten air cells of the upper layer 35 form the body-section zone 37 and the last seven air cells form the leg-section zone 38. The air cells in each zone are also fluidly interconnected with each other and both of the head-section zone 36 and the leg-section zone 38 are generally regulated to a lower pressure level. The pressures in the air cells of the head-section zone 36 and the leg-section zone 38 are always maintained constant or in a static condition. The air cells of the lower inflatable bladder layer 34 are fluidly interconnected with each other and are always regulated to the same pressure level for preventing the bottoming-out of the patient lying on the mattress 2, that is, preventing the patient directly touches the hard pan of the bed frame (not shown) at the bottom of the lower inflatable bladder layer 34. All of the target pressures in the air cells of the upper inflatable bladder layer 35 (i.e., the head-section zone 36, the body-section zone 37, and the leg-section zone 38) and the lower inflatable bladder layer 34 are controlled and operated independently from one another through the control unit 3.

The air cells of the body-section zone 37 can be controlled and adjusted in various therapy modes with various therapy intensities, and are substantially divided into two groups, i.e., a first group 40 and a second group 41. The first group of air cells and the second group of air cells are alternatively arranged in the longitudinal direction, which means that the air cells of the two groups are arranged in such a way that each cell of the first group 40 is situated between adjacent air cells of the second group 41, and vice versa, beginning with the first cell of the first group and ending with the last cell of the second group. The air cells of each of the two groups are fluidly interconnected and regulated to a certain target pressure level for a certain therapy mode set through the control unit 3.

Referring to FIGS. 2 and 3, the mattress 2 in accordance with the present invention also comprises a cardio pulmonary resuscitation (CPR) assembly 90. The CPR assembly 90 is connected with each of the head-section zone 36, the body-section zone 37, the leg-section zone 38, and the lower bladder layer 34 through a plurality of pneumatic hoses 43, and it is located in the vicinity of a front end of the body-section zone 37. The CPR assembly 90 can be manually switched between an exhaust state and a sealed state. In operation, the CPR assembly 90 is initially set in the sealed state and the air in each zone is blocked from leaking to an external atmosphere by a CPR cap 91. In the exhaust state, each zone is opened to the external atmosphere, and the air in each zone will be exhausted rapidly through the CPR assembly 90. A CPR sensing pipe 92 is connected to the CPR assembly 90 while the pressurized air is supplied through a compressor 32, and the pressure level of the pressurized air in the CPR sensing pipe 92 is measured and monitored by a pressure sensor 47 provided in a controller 30 of the control unit 3. Once the CPR assembly 90 is switched to the exhaust state, the controller 30 will detect that the air pressure in the CPR sensing pipe 92 is decreasing, which means the CPR assembly 90 has been opened. Thus, the compressor 32 in the control unit 3 is turned off by the controller 30 and then all of the valves 45 are changed to the exhaust state, such that a CPR indicator (not shown) provided on the user interface 31 is turned on.

Quick Connector Structure

Referring to FIGS. 2 and 3, the mattress 2 is connected with the control unit 3 through the connection pipe 4 such that an airflow path is formed between the mattress 2 and the control unit 3. More specifically, the connection pipe 4 is an integrated plastic extrusion line including a plurality of tube linings, such that a respective airflow path for connecting each zone of the mattress 2 to an individual port of an air distributor 33 provided in the control unit 3 is formed. An integration connector 10 is used to connect the connection pipe 4 with the control unit 3 so as to provide a function of easy use and thus a quick connection/disconnection operation between the connection pipe 4 and the control unit 3.

Active Coverlet

Figure 9A:
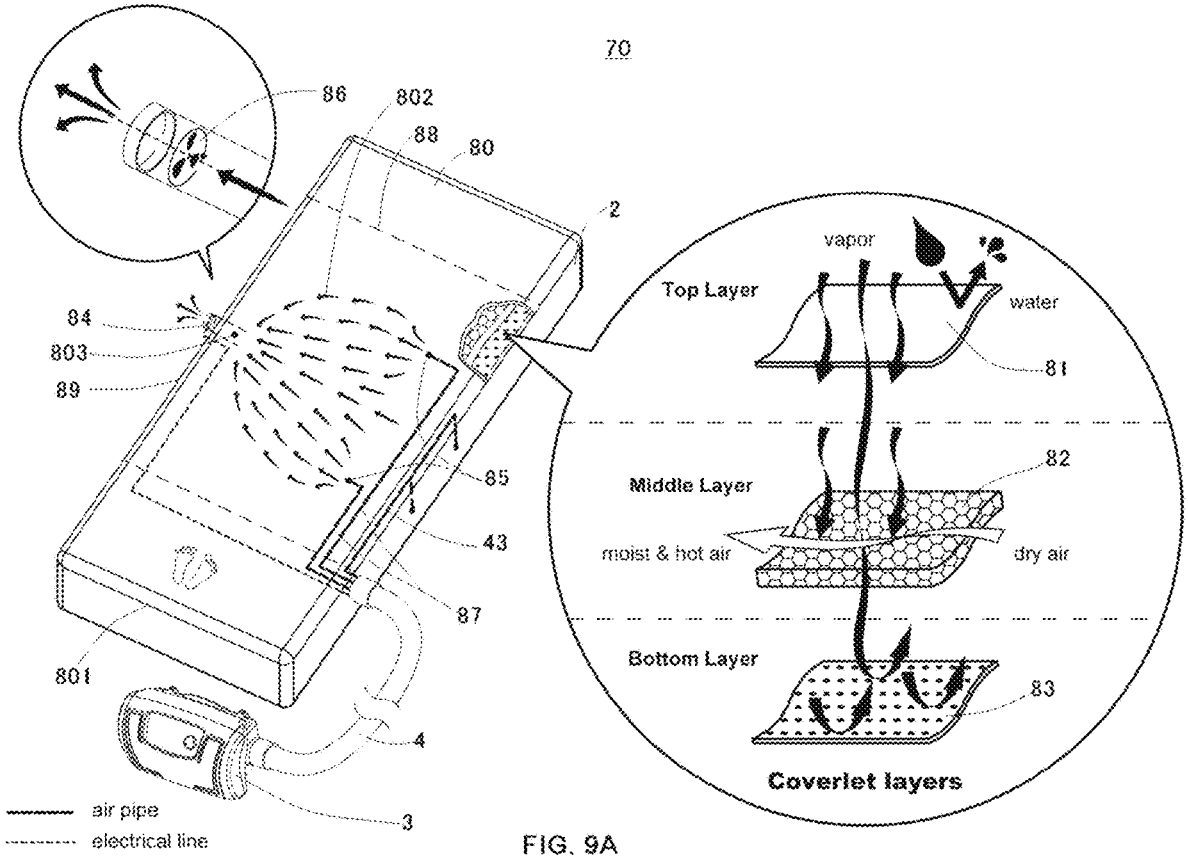
FIG. 9(A) is a schematic view showing an active coverlet in accordance with the present invention.
Figure 9B:
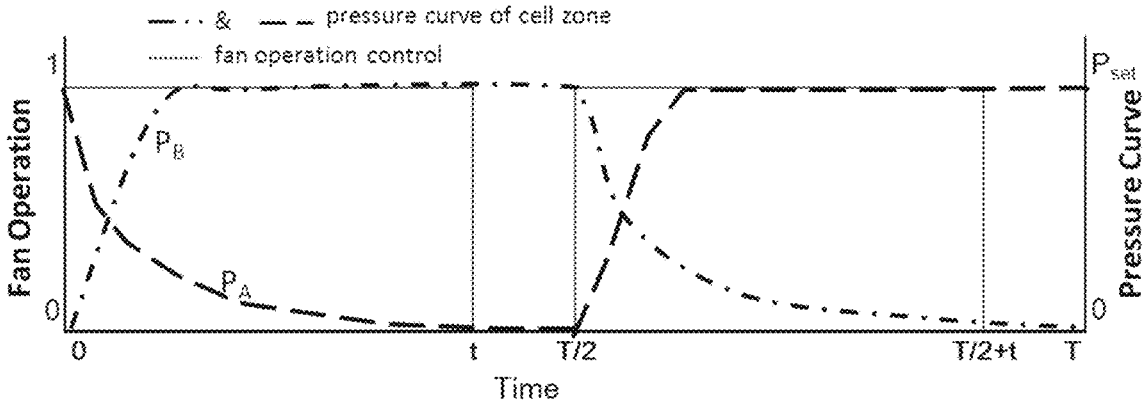
FIG. 9(B) is a graph showing fan operations over time with respect to the pressure curves of the two groups of air cells in the body-section zone.

FIG. 9(A) is a schematic view showing an active coverlet in accordance with the present invention, and FIG. 9(B) is a graph showing the fan operations over time with respect to the pressure curves of the two groups of air cells in the body-section zone.

As known from the review of clinical literature, the heat and perspiration accumulated on a contact surface between the patient's body and the mattress has a remarkable effect on both of the formation and the deterioration of pressure ulcers. In real practices, however, it is necessary to prevent the occurrence of such a problem in advance. Therefore, an active coverlet 70 is provided to actively and adequately control the removal of excessive heat and moisture from the contact surface between the patient's body and the mattress 2.

Referring to FIG. 9(A), the active coverlet 70 is designed to be covered on the mattress 2 as an interface between the patient's body and the mattress and mainly made up of three parts: a fan assembly 84, a plurality of air pipes 87, and a coverlet body 80. The coverlet body 80 is divided into three regions, which are respectively corresponding to the head-section zone 36, the body-section zone 37, and the leg-section zone 38 of the mattress 2, and separated with the weld lines 88. The region corresponding to the body-section zone 37 of the mattress 2 has a function of transferring the moisture and heat from the patient's body to outside, and consists of three fabric layers. As shown in the enlarged view of the region corresponding to the body-section zone 37 in FIG. 9(A), the first fabric layer (top layer) 81 is a layer which is closest to the patient's body and has a property of water impermeability and vapor permeability. Due to the property of vapor permeability, the moisture and heat generated from the patient's body can be transferred through this region where a humidity gradient across the interface between the patient's body and the mattress exists. The second fabric layer (middle layer) 82 is water and vapor permeable, and the third fabric layer (bottom layer) 83 is water and vapor impermeable and can be used to isolate the moisture from the air cells of the body-section zone 37 of the mattress 2. The middle layer 82 formed with a three-dimensional porous structure is placed within an enclosure as an air channel, and has a good elasticity under compression. In other words, when the middle layer 82 is pressed with a force, it can easily returns to its original state or structure once the force is released. Further, although the middle layer 82 is compressed, it still can allow the air to be flowed within the enclosure due to the porous structure.

Therefore, the moisture and the heat generated from the patient's body can be continuously carried away through airflows 802 underneath the top layer 81 and then extracted out of the enclosure through an air outlet 803. Considering the cost and the effectiveness for the redistribution of the interface pressure between the patient and the mattress, the thickness of the middle layer 82 is preferably as thin as possible. There is a zipper 89 provided on one side of an air travel zone (not shown) for the installation and replacement of the middle layer. Another zipper 801 is provided around the sides of the active coverlet 70 and used to secure the active coverlet 70 with the mattress 2. With the zippers 89 and 801, the active coverlet 70 and the middle layer 82 can be easily and readily attached to or removed from the mattress 2 for sanitization and maintenance purposes. Two air inlet ports 85 are welded on one side of the coverlet body 80 and connected to the air distributor 33 of the control unit 3 via a plurality of air pipes 87. When the mattress system 1 is operating in a certain therapy mode, the air is exhausted from the air cells through the pneumatic pipes 43 and distributed into the coverlet body 80 through the air inlet ports 85 so as to remove the moisture. The air outlet port 803 is welded on a side of the coverlet body 80 opposite to the side of the air inlet port 85 and connected to the fan assembly 84, in which a fan 86 vacuums the air out of the coverlet body 80. The operations of the inlet and outlet airflows are controlled through the controller 30 of the system 1.

Control Unit

Referring back to FIGS. 1 to 3, the control unit 3 in accordance with present invention comprises an enclosure 11 to accommodate and protect the functional components inside the control unit 3, for example, the controller 30, the compressor 32, the air distributor 33, and so on. As shown in FIG. 1, the user interface 31 is provided on an outer surface of the enclosure 11 such that the caregiver can control and learn the status of the mattress system 1 in an indicator display. The user interface 31 includes a turning knob 42 which can be rotated in both directions, i.e., clockwise and counter-clockwise directions. The design of the user interface 31 is particularly suitable for the caregiver to make a continuous integral adjustment of the mattress system 1 with respect to any aspect of the patient comfort level, the therapy mode and the therapy intensity level.

As described in the above, most of the functional components are accommodated and protected inside the control unit 3 by the enclosure 11 so as to control the operation processes of the mattress system 1. At first, the controller 30 receives a signal (command) from the user interface 31 and enables the pressure sensor 47 to measure and monitor the pressure in each of the zones of the mattress 2. Then, the controller 30 sends a signal (command) to drive the functional components such as the compressor 32 and the air distributor 33 to provide and distribute airflow into the mattress 2.

The controller 30 is provided with a software program so as to allow the mattress system 1 to be operated in various therapy modes and with different intensity levels in response to the signal from the user interface 31. The pressure sensor 47 is provided inside the controller 30 and connected to each of the zones of the mattress 2 via the plurality of pneumatic hoses 43, which is collectively shown as one pneumatic hose 43 in FIG. 2 for simplicity.

The compressor 32 is used as an air source of the system 1 to be connected to the controller 30 through an electrical wire 44 for transferring electrical power. An air outlet (not shown) of the compressor 32 is connected to each cell of the zones of the mattress 2 through the plurality of pneumatic hoses 43 via the air distributor 33. By controlling the statuses of the compressor 32 and the air distributor 33, the operation of distributing the airflow into each cell of the mattress 2 can be performed by the controller 30.

As shown in FIG. 3, the air distributor 33 is made up of a plurality of valve units 45 and a distributor body 46. Each of the valve units 45 is driven with a two-way solenoid valve or a three-way solenoid valve (not shown). The valve unit 45 is designed with an excellent hermetic seal and noiseless performance. The distributor body 46 is configured with such a structure that a plurality of internal air channels (not shown) is interconnected with each other. The assembly of the valve units 45 and the distributor body 46 allows the controller 30 to regulate the valve units 45 in different states. The distribution status can be determined by both of the status of each valve unit 45 and the design of the internal air channels in the distributor body 46. Then, the air generated by the compressor 32 will be distributed into the air cells of the zones of the mattress 2 through the air distributor 33 in response to the command (signal) from the controller 30.

System Functions

The system functions of the mattress system 1 will be described in the following sections.

Comfort Level, Therapy Intensity Level and Therapy Mode

Figure 4:
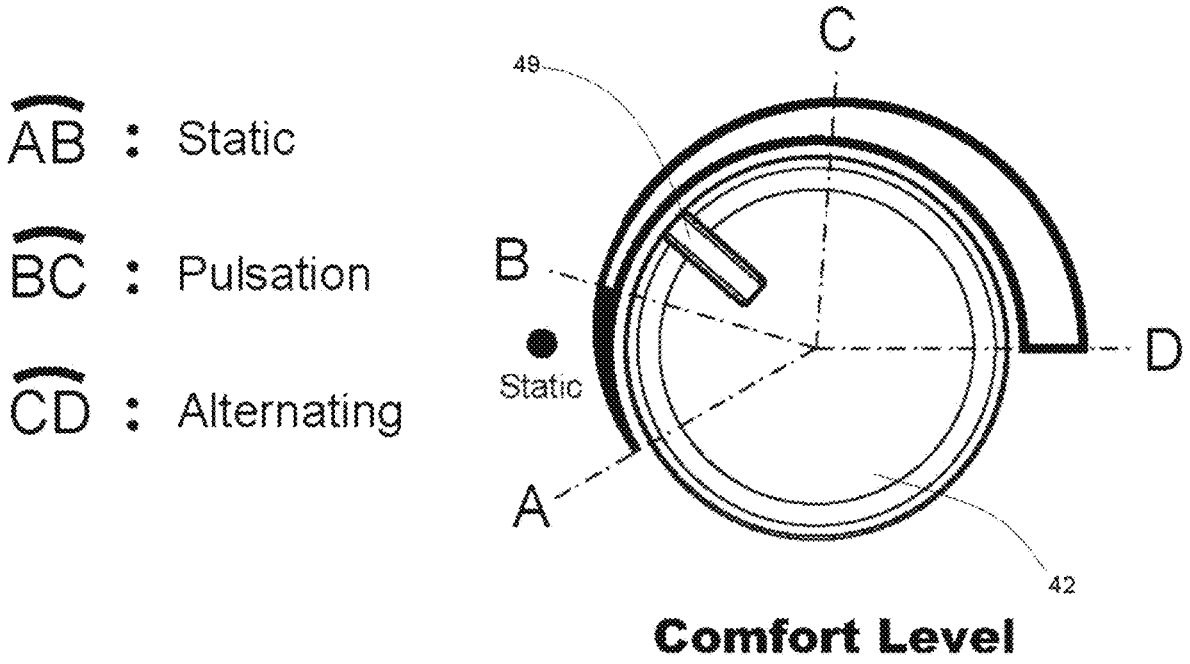
FIG. 4 shows a representation of a turning knob with an indication of the comfort level and therapy mode.
Figure 5:
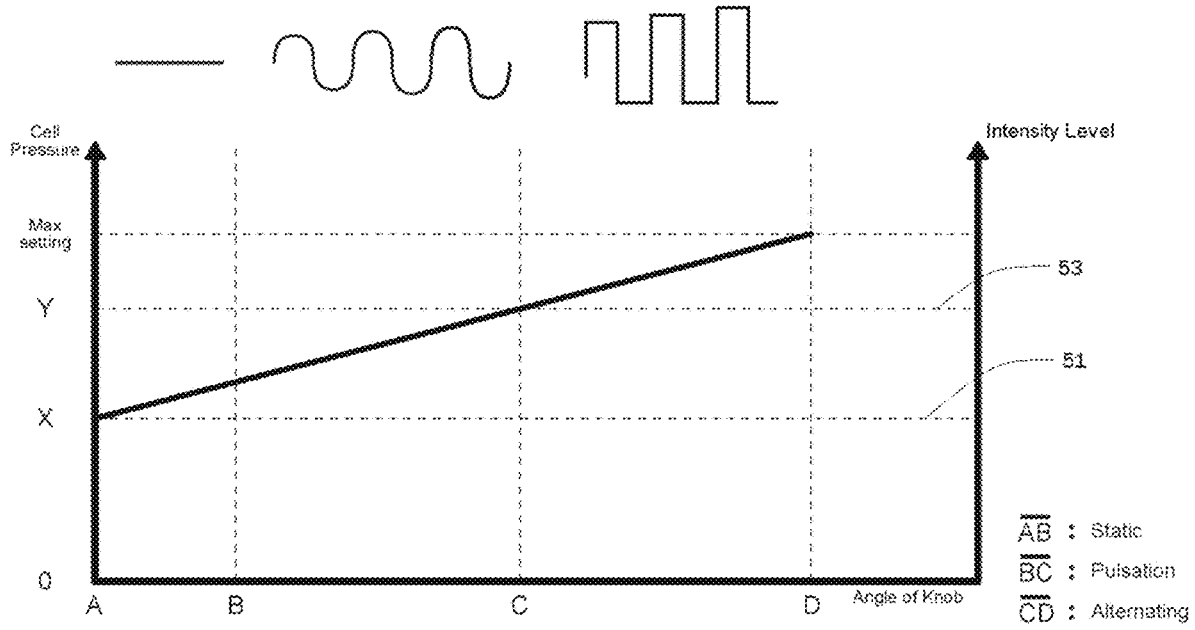
FIG. 5 shows the relationships among the supporting pressure level, the therapy mode and the therapy intensity level.

FIG. 4 shows a representation of the turning knob 42 with an indication of the comfort level and the therapy mode. FIG. 5 shows the relationships among the supporting pressure level, the therapy mode and the therapy intensity level.

The therapy performance of the mattress system 1 and the comfort level of the patient 39 are determined based on the command (signal) from the user interface 31 provided on the control unit 3. The comfort level, the therapy mode and the therapy intensity level of the system 1 can be adjusted by rotating the turning knob 42 of the user interface 31. By rotating a protrusion bar 49 provided on the turning knob 42 from a start position marked with A to an end position marked with D on the user interface 31, the controller 30 can generate various signals representing different therapy modes based on readings of the rotation angle of the turning knob 42. More specifically, as shown in FIG. 4, there are three therapy modes to be provided with the use of the turning knob 42, i.e., a static therapy mode by rotating the turning knob 42 from the position A to a position B (labeled with arc line AB), a pulsation therapy mode from the position B to a position C (labeled with arc line BC), and an alternating therapy mode from the position C to the position D (labeled with arc line CD).

In FIG. 5, the horizontal axis represents the comfort level indicated with A, B, C and D marked on the turning knob 42, the vertical axis on the left side represents the supporting pressure level, and the vertical axis on the right side represents the therapy intensity level. First, the therapy intensity level can be determined when one of the three therapy modes is selected. As shown in FIG. 5, in the pulsation therapy mode and the alternating therapy mode, for example, a difference in the pressure levels between the first group of air cells 40 and the second group of air cells 41 can be recognized as the intensity level of the therapy mode. A low intensity level means the difference of the pressure levels is small while a high intensity level means the difference of the pressure levels is large. The intensity level of the therapy mode is determined by the reading of the rotation angle of the turning knob 42. The intensity level of the therapy mode will be changed when the turning knob 42 is rotated from the position A to the position D, and vice versa.

Next, a degree of the comfort level of the mattress system 1 to support the patient on the mattress 2 can be determined. For a patient lying on the mattress, when the system is operating in the static therapy mode, he will feel more comfortable than the system is operating in the pulsation therapy mode and the alternating therapy mode, because the static therapy mode is particularly designed for a static pressure and soft support. Therefore, the protrusion bar 49 positioned at the position A on the turning knob 42 indicates that the system is operating in the static mode and the patient lying on the mattress 2 feels that the mattress is in its softest state. When the turning knob 42 is gradually rotated from the position A toward the position D, the pressure in each cell is gradually increased as the degree of the comfort level is gradually changed. The protrusion bar 49 moved from the position A to the position B indicates the system 1 is operating in the static mode (segment AB in FIG. 5). After the pressure in each cell is increased to a certain level, which means that the protrusion bar 49 is moved from the position B to the position C, the system 1 will proceed to another degree of comfort level, which indicates the system is operating in the pulsation therapy mode (segment BC in FIG. 5). The therapy intensity level is increased when the degree of the comfort level becomes lower. That is, a higher therapy intensity level indicates a lower comfort level. After the pulsation therapy mode, the system 1 will proceed to the alternating mode (segment CD in FIG. 5) by continuously rotating the protrusion bar 49 of the turning knob 42 toward the position D. With the increased difference in the pressure levels, the degree of the comfort level gets worse since the supporting pressure level of the mattress 2 becomes larger. When the protrusion bar 49 of the turning knob 42 is rotated to the position D, the patient feels that the mattress 2 is in its stiffest state, which corresponds to the worst comfort level.

Figure 6:
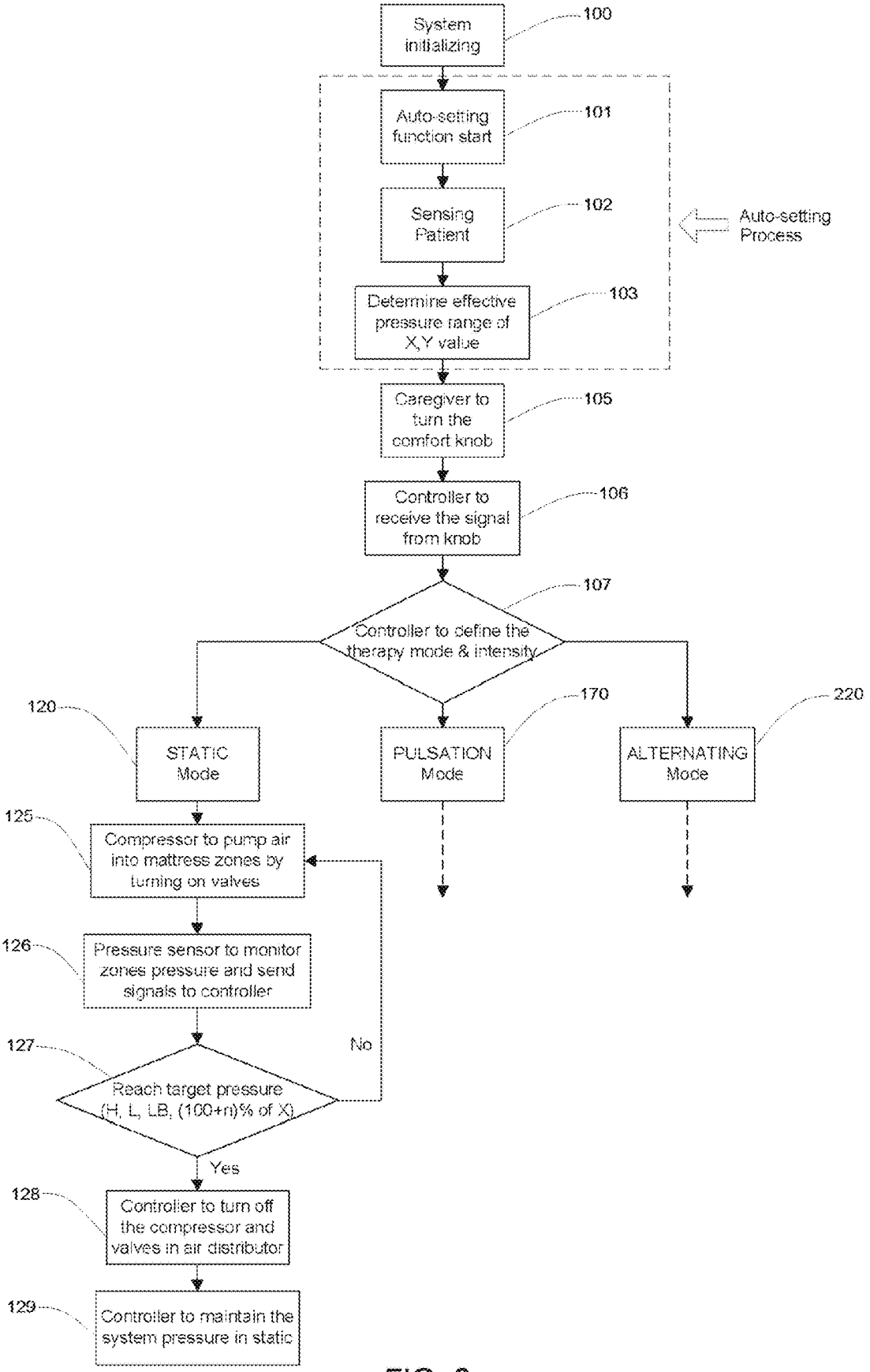
FIG. 6 shows a flow chart of the operation process of the mattress system in accordance with the present invention when it is operating in the static therapy mode, the pulsation therapy mode, and the alternating therapy mode.
Figure 7:
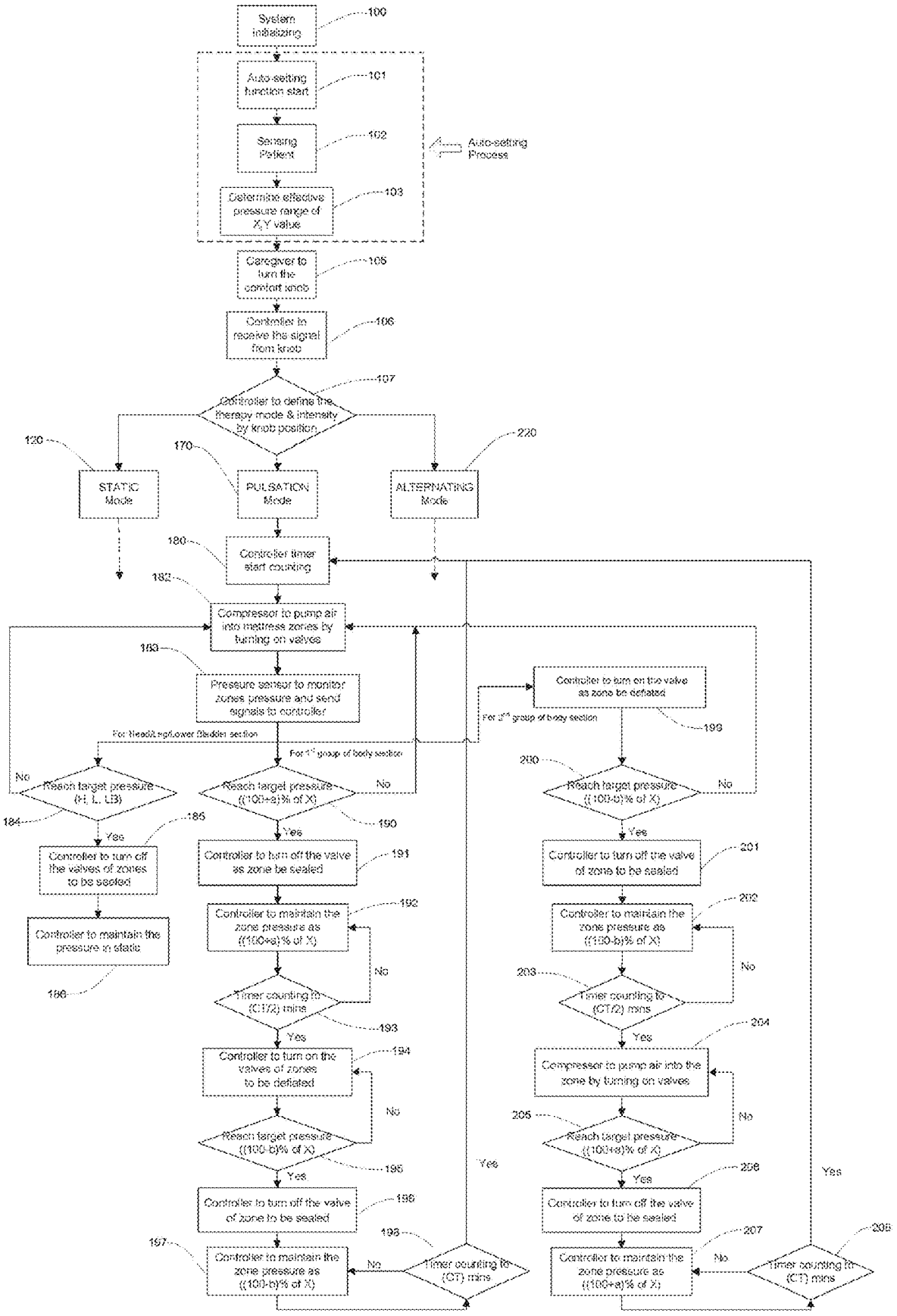
FIG. 7 shows a flow chart of the operation process of the mattress system in accordance with the present invention when it is operating in the pulsation therapy mode.
Figure 8:
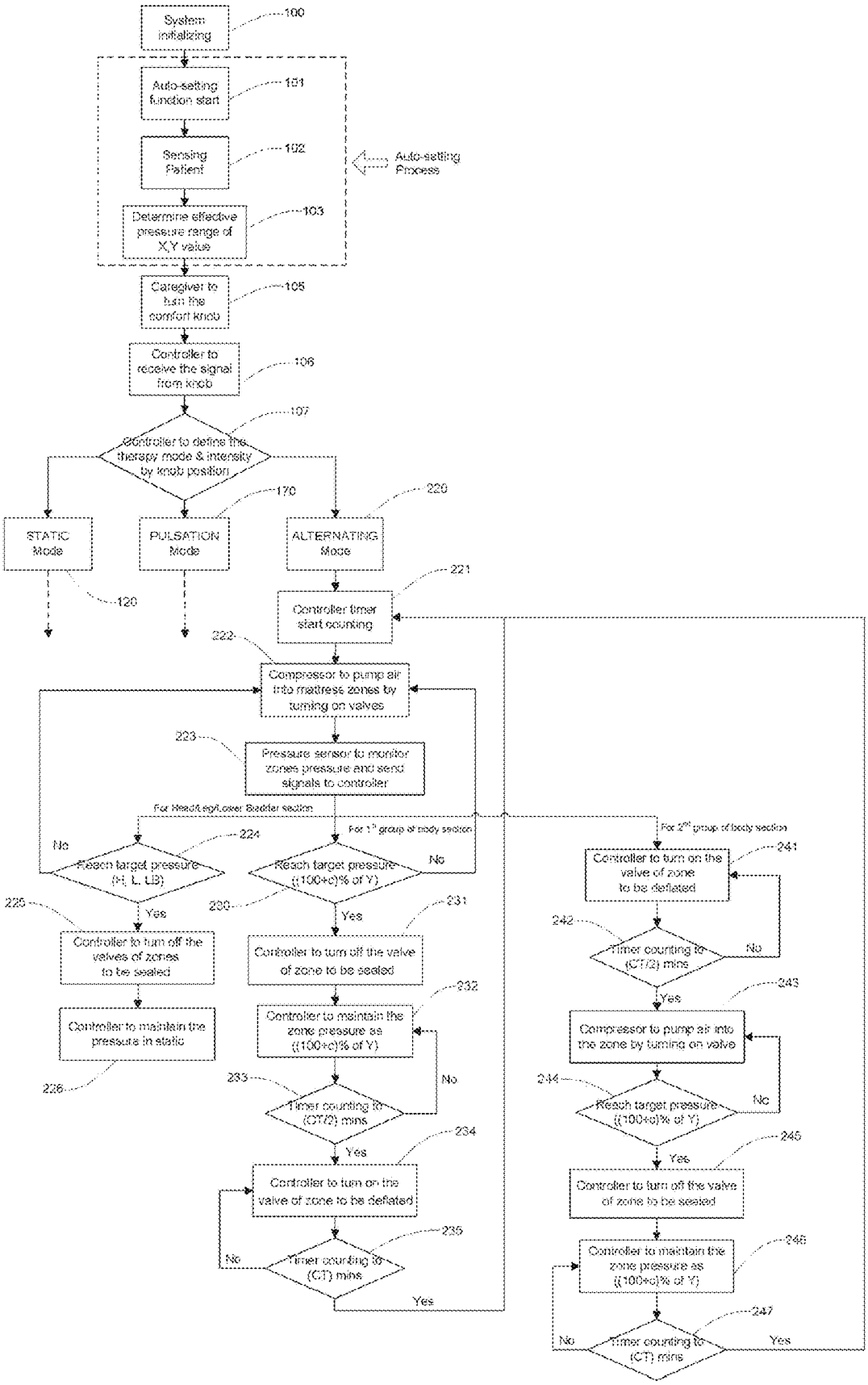
FIG. 8 shows a flow chart of the operation process of the mattress system in accordance with the present invention when it is operating in the alternating therapy mode.

The operation process of the mattress system 1 will be described with reference to FIGS. 6 to 8. FIGS. 6 to 8 are flow charts respectively showing the operation processes of the mattress system 1 in accordance with the present invention in the static therapy mode, the pulsation therapy mode, and the alternating therapy mode.

To provide a promised therapeutic effect by the mattress system 1 in accordance with the present invention, a proof-theoretical study obtained from clinical tests and papers is very important for the system 1 to follow; many studies and conclusions will be described later. From the clinical results, it is clear that a purpose of an auto-setting function is to ensure that every patient lying on the mattress 2 of the system 1 can be supported with a therapeutic and effective supporting pressure of the mattress 2, no matter which one of the therapy modes or the therapy intensity is selected.

Referring to FIG. 5, in the static mode, a dotted line 51 with a value X marked on the supporting pressure axis represents the lowest supporting pressure required for the patient whose body characteristics having been sensed. The value X is the first required output from the auto-setting process to controller 30 for each patient lying on the mattress.

Still referring to FIG. 5, in the alternating mode, a dotted line 53 with a value Y marked on the supporting pressure axis represents the lowest inflated supporting pressure required for the patient whose body characteristics having been sensed. The value Y is the second required output from auto-setting process to controller 30 for each patient lying on the mattress.

More details regarding the relationship between the therapy of the mattress system and the X and Y values of the supporting pressure will be described later in the explanation of the auto-setting process.

As shown in FIG. 6, the operation process of the mattress system 1 begins with an initialization of the system. In step 100, the system 1 is initialized, and a signal will be sent from the controller 30 to power on the compressor 32, and then the air distributor 33 is activated to inflate all of the zones in the mattress 2 such that the pressure in each of the air cells has been reached to a pre-determined value, for example, 10 mmHg. After the system initialization has been performed, the system 1 is ready to enter the auto-setting process including steps 101 to 103, such that an auto-setting function can be obtained. The auto-setting process is firstly performed in step 101, in which the patient 39 is lying on the mattress 2. Next, the patient goes through with a sensing procedure in step 102 such that an effective range of pressure for the mattress 2 to support the patient lying thereon can be determined by the controller 30 of the system 1 in step 103. The auto-setting process will be further discussed later in detail.

After the auto-setting process is completed, the system 1 will be ready for the caregiver to select a comfort level suitable for the patient with which the therapy can be performed. In step 105, the caregiver rotates the turning knob 42 to select the suitable comfort level for the patient. Once the comfort level is determined, a signal including the information regarding reading of the rotation angle of the turning knob 42 will be sent from the turning knob 42 to the controller 30 in step 106. Then, the therapy mode and the therapy intensity level corresponding to the reading of the rotation angle of the turning knob 42 can be determined in step 107. The operation processes for the three types of therapy modes will be described with reference to FIGS. 6 to 8 in the following.

Static Therapy Mode

The first type of therapy mode is referred to as the static therapy mode ("static mode" for abbreviation). In step 120, the operation process of the static mode is discussed with reference to FIG. 6. If the static mode is determined, both of the compressor 32 and the air distributor 33 will be activated by the controller 30 such that the air is pumped into the air cells of all of the zones by opening the valves 45 to inflate the air cells in each of the zones to a specific target pressure in step 125. The pressure in each cell of the zones will be continuously monitored and measured by the pressure sensor 47 inside the controller 30 through the pneumatic connections 43 and a signal will be sent to the controller 30 in step 126.

The specific target pressure of the body-section zone 37 can be determined from the output obtained in the auto-setting process and the reading of the rotation angle of the turning knob 42. In the static mode, the specific target pressure is defined as (100+n) % of X, where X is previously described to be the lowest supporting pressure required for the patient whose body characteristics having been sensed. The value of "n" will be determined by the therapy intensity. The specific target pressure of the head-section zone 36, the leg-section zone 38 and the lower bladder zone 34 will be always maintained in a stable low pressure level such that a better comfort level and therapeutic effect can be obtained. The specific target pressure is respectively defined as "H" mmHg for the head-section zone 36, "L" mmHg for the leg-section zone 38, and "LB" mmHg for the lower bladder zone 34.

Whether the specific target pressure for each of the zones has been reached is determined in step 127. If the specific target pressure for each of the zones has not been reached, the operation process returns to step 125 and the compressor 32 will keep pumping the air into the air cells of the zones through the valves 45 of the air distributor 33. Once the specific target pressure in each cell of any of the zones has been reached, the valve 45 of the air distributor 33 connected to that zone will be automatically closed to stop the supply of the air to that zone. Nonetheless, the compressor 32 will keep on pumping and supplying the air until all of the air cells in each of the zones have been inflated to reach to the specific target pressure level. If the specific target pressure level for each of the zones has been reached, the operation process proceeds to step 128 and the controller 30 will deactivate the compressor 32 and then the valves 45 in the air distributor 33 will be closed so as to keep the pressure in the mattress 2 within a static pressure level. Then, the status of the pressure level in each zone will be continuously monitored by the controller 30 so as to be maintained within the static pressure level in step 129.

Pulsation Therapy Mode

The second type of therapy mode is referred to as the pulsation therapy mode ("pulsation mode" for abbreviation). In step 170, the operation process of the pulsation mode is discussed with reference to FIG. 7. Once the pulsation mode is determined, the controller 30 enables a timer to start counting a cycle time in step 180, and the cycle time is initially set to be "CT" minutes. Then, the compressor 32 and the air distributor 33 are both activated by the controller 30 such that the air is pumped into the air cells of the zones by opening the valves to inflate the air cells in each of the zones to a specific target pressure level in step 182. The pressure in each cell of the zones will be continuously monitored and measured by the pressure sensor 47 inside the controller 30 through the pneumatic connections 43 and a signal will be sent to the controller 30 in step 183. However, please note that the operation process of the system 1 at this stage will be divided into three cases to further discussion. That is, the operation process will proceed to step 184 for the head-section zone 36, the leg-section zone 38 and the lower bladder zone 34, to step 190 for the first group of air cells in the body-section zone 40, and to step 200 for the second group of air cells in the body-section zone 41.

For the first case, the effective supporting pressure of the mattress 2 is controlled to be in the stable low-pressure level. The target pressure of each zone will be set to the "H","L" and "LB" mmHg respectively for the head-section zone 36, the leg-section zone 38 and the lower bladder zone 34. Whether the target pressure for each of the above three zones has been reached is determined in step 184. If the target pressure for each of the zones has not been reached, the operation process returns to step 182 and the compressor 32 will keep pumping the air into the air cells of each of the zones through the valves 45 of the air distributor 33. Once the target pressure in each cell of any of the zones has been reached, the valve 45 of the air distributor 33 connected to that zone will be automatically closed to stop the supply of the air to that zone. The compressor 32 will keep on pumping and supplying the air until all of the air cells in each of the zones have been inflated to reach to the target pressure level. If the target pressure level for each of the zones has been reached, the operation process proceeds to step 185 and the controller 30 will power off the compressor 32 and then the valves 45 in the air distributor 33 are closed so as to keep the mattress 2 within a static pressure level. Then, the status of the pressure level in each zone will be continuously monitored by the controller 30 so as to be maintained within the static pressure level in step 186.

For the second case, whether the target pressure for each cell in the first group 40 of the body zone 37 has been reached to (100+a) % of X mmHg is determined in step 190, where X is the lowest supporting pressure required for the patient whose body characteristics having been sensed. The value of "a" will be determined by the controller 30 based on the therapy intensity which is obtained from the reading of the rotation angle of the turning knob 42. The value of "a" becomes larger when the therapy intensity becomes higher, and the upper limit is set to [(100+a) % of X] to be equal to Y, where Y is described previously as the lowest inflated supporting pressure required for the patient whose body characteristics having been sensed in the alternating mode. If the target pressure of (100+a) % of X for each cell in the first group of the body-section zone has not been reached, the operation process returns to step 182 and the compressor 32 will keep pumping the air into the air cells of the first group of the body-section zone through the valves 45 of the air distributor 33. Once the target pressure in each cell of the first group of the body zone has been reached, the valve 45 of the air distributor 33 connected to that zone will be automatically closed so as to stop the supply of the air to that zone. The compressor 32 will keep on pumping and supplying the air until all of the air cells in the first group of the body zone have been inflated to reach to the target pressure. If the target pressure in each cell in the first group of the body zone has been reached, the operation process proceeds to step 191 and the controller 30 will power off the compressor 32 and then the valves 45 in the air distributor 33 are closed so as to keep the mattress 2 within a static pressure. Then, the status of the pressure level in each zone will be continuously monitored by the controller 30 so as to maintain the target pressure to be (100+a) % of X in step 192. The target pressure is maintained to be (100+a) % of X until the timer counts the cycle time to be (CT/2) minutes in step 193. If the cycle time is not counted to be (CT/2) minutes, then the operation process returns to step 192. If the cycle time has been counted to be (CT/2) minutes, then the operation process proceeds to step 194. In step 194, the valves 45 of the first group of the body zone are opened to deflate the air cells thereof. The target pressure in each of the air cells of the deflated zone is set to be (100−b) % of X mmHg, where the value of "b" is defined by the controller 30 according to the therapy intensity obtained from the reading of the rotation angle of the turning knob 42. The value of "b" is getting larger when the therapy intensity becomes higher, and thus the difference in pressure is increased. Whether the target pressure for each cell in the first group of the body zone has been reached to (100−b) % of X mmHg is determined in step 195. If the target pressure of (100−b) % of X for each cell in the first group of the body zone has not been reached, the operation process returns to step 194. If the target pressure of (100−b) % of X has been reached, the operation process proceeds to step 196. In step 196, the controller 30 powers off the compressor 32 and then the valves 45 in the air distributor 33 are closed so as to keep the pressure in the mattress 2 within a desired pressure level. Then, the status of the pressure level in each zone will be continuously monitored by the controller 30 such that the target pressure is maintained to be (100−b) % of X in step 197. The target pressure will be maintained to be (100−b) % of X until the timer counts the cycle time to be (CT) minutes in step 198. If the cycle time is not counted to be (CT) minutes, then the operation process returns to step 197. If the cycle time is counted to be (CT) minutes, then the operation process returns to step 180. In step 180, the controller 30 will enable the timer to reset for another cycle time.

For the third case, the values 45 are opened by the controller 30 to exhaust the air in the second group of air cells 41 of the body-section zone 37 to outside in step 199. Then, whether the target pressure for each cell in the second group 41 of the body zone 37 has been reached to (100−b) % of X mmHg is determined in step 200. The value of "b" is defined by controller 30 according to the therapy intensity obtained from the reading of the rotation angle of the turning knob 42. The value of "b" is larger when the therapy intensity is higher. If the target pressure of (100−b) % of X for each cell in the second group of the body zone has not been reached, the process returns to step 182. If the target pressure of (100−b) % of X has been reached, the operation process proceeds to step 201 and the controller 30 will power off the compressor 32, and then the valves 45 in the air distributor 33 are closed so as to keep the pressure in the mattress 2 within a static pressure level. Then, the status of the pressure level in each zone will be continuously monitored by the controller 30 so as to maintain the target pressure to be (100−b) % of X in step 202. The target pressure is maintained to be (100−b) % of X until the timer counts the cycle time to be (CT/2) minutes in step 203. If the cycle time is not counted to be (CT/2) minutes, then the operation process returns to step 202. If the cycle time is counted to be (CT/2) minutes, then the process proceeds to step 204. In step 204, the compressor 32 and the air distributor 33 will be activated by the controller 30 such that the air is pumped into the air cells in the second group of the body zone by opening the valves 45 to inflate the air cells in the second group of the body zone to a target pressure (100+a) % of X mmHg. Whether the target pressure for each cell in the second group 41 of the body zone 37 has been reached to (100+a) % of X mmHg is determined in step 205. The value of "a" will be determined by the controller 30 according to the therapy intensity obtained from the rotation angle of the turning knob 42. The value of "a" is larger when the therapy intensity is higher, and the upper limit is set to [(100+a) % of X] to be equal to Y, where the value of "Y" is the lowest pressure set in the alternating mode. If the target pressure of (100+a) % of X for each cell in the second group of the body zone has not been reached, the operation process returns to step 204 and the compressor 32 will keep pumping the air into the air cells in the second group of the body zone through the valves 45 of the air distributor 33. If the target pressure in each cell in the second group of the body zone has been reached, the process proceeds to step 206 and the controller 30 will power off the compressor 32 and then the valves 45 in the air distributor 33 are closed so as to keep the mattress 2 within a target pressure. Then, the status of the pressure level in each zone will be continuously monitored by the controller 30 so as to maintain the target pressure to be (100+a) % of X in step 207. The target pressure is maintained to be (100+a) % of X until the timer counts the cycle time to be (CT) minutes in step 208. If the cycle time is not counted to be (CT) minutes, then the operation process returns to step 207. If the cycle time is counted to be (CT) minutes, then the operation process returns to step 180. In step 180, the controller 30 will enable to reset the timer for another cycle time.

Alternating Therapy Mode

The third type of therapy mode is referred to as the alternating therapy mode ("alternating mode" for abbreviation). In step 220, the operation process of the alternating mode is discussed with reference to FIG. 8. Once the alternating mode is determined, the controller 30 enables a timer to start counting a cycle time in step 221, and the cycle time is initially set to be "CT" minutes. Then, the compressor 32 and the air distributor 33 are both activated by the controller 30 such that the air is pumped into the air cells of the zones by opening the valves to inflate the air cells in each of the zones to a specific target pressure level in step 222. The pressure in each cell of the zones will be continuously monitored and measured by the pressure sensor 47 inside the controller 30 through the pneumatic connections 43 and a signal will be sent to the controller 30 in step 223. Again, please note that the operation process of the system 1 at this stage will be divided into three cases to further discussion. That is, the operation process will proceed to step 224 for the head-section zone 36, the leg-section zone 38 and the lower bladder zone 34, to step 230 for the first group of air cells in the body-section zone 40, and to step 241 for the second group of air cells in the body-section zone 41.

For the first case, the effective supporting pressure of the mattress 2 is controlled to be in the stable low-pressure level. The target pressure of each zone will be set to the "H","L" and "LB" mmHg respectively for the head-section zone 36, the leg-section zone 38 and the lower bladder zone 34. Whether the target pressure for each of the above three zones has been reached is determined in step 224. If the target pressure for each of the zones has not been reached, the operation process returns to step 222 and the compressor 32 will keep pumping the air into the air cells of each of the zones through the valves 45 of the air distributor 33. Once the target pressure in each cell of any of the zones has been reached, the valve 45 of the air distributor 33 connected to that zone will be automatically closed to stop the supply of the air to that zone. The compressor 32 will keep on pumping and supplying the air until all of the air cells in each of the zones have been inflated to reach to the target pressure level. If the target pressure level for each of the zones has been reached, the operation process proceeds to step 225 and the controller 30 will power off the compressor 32 and then the valves 45 in the air distributor 33 are closed so as to keep the pressure in the mattress 2 within a static pressure level. Then, the status of the pressure level in each zone will be continuously monitored by the controller 30 so as to be maintained within the static pressure level in step 226.

For the second case, whether the target pressure for each cell in the first group 40 of the body zone 37 has been reached to (100+c) % of Y mmHg is determined in step 230, where Y is described previously as the lowest inflated supporting pressure required for the patient whose body characteristics having been sensed in the alternating mode. The value of "c" will be determined by the controller 30 based on the therapy intensity obtained from the reading of the rotation angle of the turning knob 42. The value of "c" is getting larger when the therapy intensity becomes higher, and the upper limit of "c" is set to a maximum pressure setting of the system 1. If the target pressure of (100+c) % of Y for each cell in the first group of the body-section zone has not been reached, the operation process returns to step 222 and the compressor 32 will keep pumping the air into the air cells of the first group of the body-section zone through the valves 45 of the air distributor 33. Once the target pressure in each cell of the first group of the body zone has been reached, the valve 45 of the air distributor 33 connected to that zone will be automatically closed so as to stop the supply of the air to that zone. The compressor 32 will keep on pumping and supplying the air until all of the air cells in the first group of the body zone have been inflated to reach to the target pressure. If the target pressure in each cell in the first group of the body zone has been reached, the operation process proceeds to step 231 and the controller 30 will power off the compressor 32 and then the valves 45 in the air distributor 33 are closed so as to keep the pressure in the mattress 2 within a static pressure level. Then, the status of the pressure level in each zone will be continuously monitored by the controller 30 so as to maintain the target pressure to be (100+c) % of Y in step 232. The target pressure is maintained to be (100+c) % of Y until the timer counts the cycle time to be (CT/2) minutes in step 233. If the cycle time is not counted to be (CT/2) minutes, then the operation process returns to step 232. If the cycle time has been counted to be (CT/2) minutes, then the operation process proceeds to step 234. In step 234, the valves 45 of the first group of the body zone 40 are opened to deflate the air cells thereof. The target pressure of the deflated zone is not controlled, which means the pressure normally will be deflated to zero. The deflation of the first group of the body zone will be kept performing until the timer counts the cycle time to be (CT) minutes in step 235. If the cycle time is not counted to be (CT) minutes, then the operation process returns to step 234. If the cycle time is counted to be (CT) minutes, then the operation process returns to step 221. In step 221, the controller 30 will enable the timer to reset for another cycle time.

For the third case, in step 241, the valves 45 corresponding to the second group of the body zone 41 are opened to deflate the air cells thereof. The target pressure of the deflated zone is not controlled, which means the pressure will normally be deflated to zero. The deflation of the second group of the body zone will be kept performing until the timer counts the cycle time to be (CT/2) minutes in step 242. If the cycle time is not counted to be (CT/2) minutes, then the operation process returns to step 241. If the cycle time is counted to be (CT/2) minutes, then the operation process proceeds to step 243. In step 243, the compressor 32 and the air distributor 33 will be activated by the controller 30 such that the air is pumped into the air cells in the second group of the body zone by opening the valves 45 to inflate the air cells in the second group of the body zone to a target pressure (100+c) % of Y mmHg. Whether the target pressure for each cell in the second group 41 of the body zone 37 has been reached to (100+c) % of Y mmHg is determined in step 244. If the target pressure of (100+c) % of Y for each cell in the second group of the body zone has not been reached, the process returns to step 243 and the compressor 32 will keep pumping the air into the air cells in the second group of the body zone through the valves 45 of the air distributor 33. If the target pressure in each cell in the second group of the body zone has been reached, the operation process proceeds to step 245 and the controller 30 will power off the compressor 32 and then the valves 45 in the air distributor 33 are closed so as to keep the pressure in the mattress 2 within a target pressure level. Then, the status of the pressure level in each zone will be continuously monitored by the controller 30 so as to maintain the target pressure to be (100+c) % of Y in step 246. The target pressure is maintained to be (100+c) % of Y until the timer counts the cycle time to be (CT) minutes in step 247. If the cycle time is not counted to be (CT) minutes, then the operation process returns to step 246. If the cycle time is counted to be (CT) minutes, then the operation process returns to step 221. In step 221, the controller 30 will enable to reset the timer for another cycle time.

Auto-Setting Process

The auto-setting process is performed to sense the body characteristics of the patient 39 lying on the mattress 2 of the system 1, and determine the range of the effective supporting pressure based on the sensed result of the patient by the control unit 3. To provide a promised therapeutic effect by the mattress system 1 in accordance with the present invention, a proof-theoretical study obtained from clinical tests and papers is very important for the mattress system 1 to follow. According to the clinical paper, "Bader D. L. and White S H, 1998," *The Viability of Soft Tissues in Elderly Subjects Undergoing Hip Surgery*, "Age Ageing, Vol. 27, pp. 217-221", the capillary blood pressure is approximately 29 to 40 percents of the interface pressure. Further, from another clinical paper, "Landis E. M., 1930," *Micro-Injection Studies of Capillary Blood Pressure in Human Skin*, "Heart, Vol. 15, pp. 209-228", the average value of the capillary closing pressure is approximately 32 mmHg. A therapeutic effect will be produced when the pressure exerting on a blood capillary is less than the capillary closing pressure. Therefore, a suggested interface pressure level having the therapeutic effect is below 32 mmHg in average.

According to the clinical paper, "Johnson P. C., 1989, "*The Myogenic Response in the Microcirculation and Its Interaction with other Control Systems*," Journal of Hypertension—Supplement, Vol. 7, pp. S33-S39", the therapeutic effect on pressure ulcer can be achieved by releasing the interface pressure exerted for a given period to induce reactive hyperemia.

From the clinical result, it is very clear that an purpose of the auto-setting function obtained in the auto-setting process is to make sure that every patient lying on the mattress 2 of the system 1 can be supported at an effective supporting pressure level of the mattress 2, no matter which type of therapy modes or which level of the therapy intensity is selected. For the auto-setting function, it is essential to have a thorough understanding of the patient's body characteristics. Therefore, the output of the sensed patient's body characteristics must be defined and converted to the effective supporting pressure range in each therapy mode.

Referring back to FIG. 5, in the static mode, the dotted line 51 with the value X on the supporting pressure axis represents the lowest supporting pressure required for the patient whose body characteristics have been sensed. It is necessary that the lowest supporting pressure X will yield the average interface pressure not higher than 32 mmHg, and the value X is the first required output from the auto-setting process to controller 30 for each patient lying on the mattress.

Still referring back to FIG. 5, in the alternating mode, the dotted line 53 with the value Y on the supporting pressure axis represents the lowest inflated supporting pressure required for the patient whose body characteristics having been sensed. It is necessary that the lowest inflated supporting pressure Y will allow a pressure relief function to be obvious and effective during the operation of the system 1. The lowest inflated supporting pressure Y is the second required output from the auto-setting process to controller 30 for each patient lying on the mattress.

The implementation of the auto-setting process in accordance with the present invention is described below with reference to FIGS. 10 to 20.

Three-Chamber Structure

Figure 10:
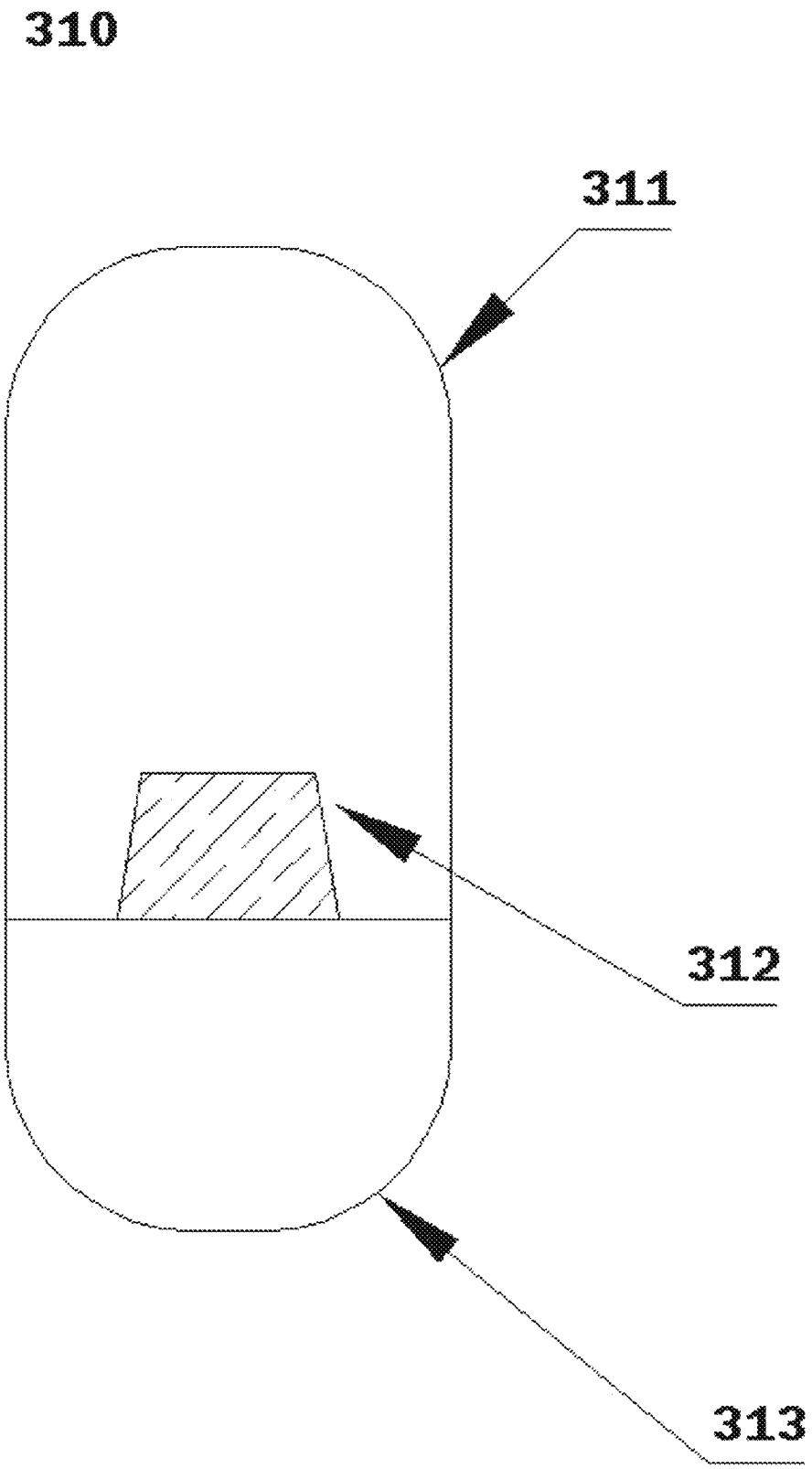
FIG. 10 is a schematic diagram showing an air cell implemented by using a three-chamber structure in the body-section zone of the mattress in accordance with the present invention.

The first scheme for implementing the auto-setting process is referred to as a "three-chamber structure". FIG. 10 is a schematic diagram showing an air cell implemented by using a three-chamber structure in the body-section zone 37 of the mattress 2 in accordance with the present invention, and FIG. 11 is a schematic cross-sectional view of the mattress when the air cell is implemented by using a three-chamber structure in the body-section zone of the mattress in accordance with the present invention. As described in the above, the body-section zone 37 of the mattress 2 is formed of the middle ten air cells and these ten air cells are divided into two groups, namely, the first group of air cells 40 and the second group of air cells 41. In this embodiment, the three-chamber structure is implemented in each of the air cells in the body-section zone 37 of the mattress 2. As shown in FIG. 10, a three-chamber air cell 310 consists of an upper bladder chamber 311, an air sensing chamber 312, and a lower bladder chamber 313, with the air sensing chamber 312 positioned at the bottom portion of the upper bladder chamber 311. As shown in FIG. 11, the air sensing chambers 312 are divided into two groups, namely, a first group of air sensing chambers 315 and a second group of air sensing chambers 316. Each group of air cells in the body-section zone 37 is fluidly interconnected and can be adjusted to be within a certain pressure level by the controller 30 of the control unit 3.

These three-chamber air cells in the body-section zone 37 can be used to detect the lowest therapeutic pressures of the upper chamber 311 in the static and alternating modes for the patient 39 lying on the mattress 2. An approach to detect the lowest therapeutic pressure X in the static mode is described below with reference to FIG. 12.

FIG. 12 is a graph showing the change of the pressure over time in each of the first group of air cells, each of the second group of air cells, each of the first group of air sensing chambers, and each of the second group of air sensing chambers when the system is go through an auto-setting process implemented with a three-chamber structure to determine the static system pressure. In FIG. 12, the controller 30 firstly enables the compressor 32 and the air distributor 33 to inflate the air cells in the body-section zone 37 of the mattress 2 at time "a". As shown in FIG. 12, two curves respectively indicate the change of the pressure over time in each of the first group of air cells 40 (labeled with PA), each of the second group of air cells 41 (labeled with PB), each of the first group of air sensing chambers 315 (labeled with PA3C), and each of the second group of air sensing chambers 316 (labeled with PB3C). Next, the patient is lying on the mattress during the period from time "a" to time "b", while the controller 30 enables the air distributor 33 and the compressor 32 to deflate or inflate the air cells in the zones of the mattress 2 until the pressure in each cell of the zones has been reached to the pre-determined pressure level. This is shown at time "b". After the pressure in each cell is stabilized, the controller 30 enables the air distributor 33 to exhaust the air from each of the first group of air cells 40 and each of the second group of air cells 41 to outside. In the period from time "b" to time "c", the pressure in each of the first group of air sensing chambers 315 and each of the second group of air sensing chambers 316 is dropped while each of the first group of air cells 40 and each of the second group of air cells 41 is deflating. At time "c", a turning point of pressure is occurred in each of the first group of air sensing chambers 315 and the second group of air sensing chambers 316. Such a change in pressure is monitored by the controller 30, while each of the first group of air cells 40 and the second group of air cells 41 is stopped deflating by controlling the air distributor 33. This is shown at time "d". Based on the approach described above, the lowest therapeutic pressure X in the static mode will be the pressure in each of the first group of air cells 40 or the second group of air cells 41 at the turning point of pressure, as shown at time "c".

The interface pressures between the patient 39 and the mattress 2 when the patient is lying on the mattress can be measured by using a measuring device called "Innovative Pressure Mapping Solutions" manufactured by the "Vista Medical Ltd.". FIG. 13 illustrates an experimental result showing the values of the interface pressure between the patient and the mattress obtained by using the Innovative Pressure Mapping Solutions when the system is operating in the static mode and going through the auto-setting process implemented with a three-chamber structure. In FIG. 13, the experimental result indicates that the lowest therapeutic pressure X is 8.9 mmHg for a male patient C of 180 cm height and 80 kg weight, and the distribution of the interface pressures between the patient and the mattress is shown. The experimental data in FIG. 13 also show that the average interface pressure is less than 32 mmHg, which satisfies the criteria described in the Landis's clinical paper. Therefore, it has been proved that the male patient of 180 cm tall and 80 kg weight has therapeutic effect at the lowest therapeutic pressure X of 8.9 mmHg. With reference to FIG. 13, it is shown that the patients with different predetermined pressure X have an average interface pressure less than 32 mmHg. In consequence, the three-chamber structure implemented in the air cells of the body-section zone 37 of the mattress 2 in accordance with the present invention can be used to determine the lowest therapeutic pressure X in the static mode.

An approach to detect the lowest therapeutic pressure Y in the alternating mode is described below with reference to FIG. 14. FIG. 14 is a graph showing the change of the pressure over time in each of the first group of air cells, each of the second group of air cells, each of the first group of air sensing chambers, and each of the second group of air sensing chambers when the system is go through an auto-setting process implemented with a three-chamber structure to determine the alternating system pressure. In FIG. 14, the controller 30 firstly enables the compressor 32 and the air distributor 33 to inflate the air cells in the body-section zone 37 of the mattress 2 at time "a". As shown in FIG. 14, four curves respectively indicate the pressure change over time in each of the first group of air cells 40 (labeled with PA), each of the second group of air cells 41 (labeled with PB), each of the first group of air sensing chambers 315 (labeled with PA3C), and each of the second group of air sensing chambers 316 (labeled with PB3C). Next, the patient is lying on the mattress during a period from time "a" to time "b", while the controller 30 enables the air distributor 33 and the compressor 32 to deflate or inflate the air cells in the zones of the mattress 2 until the pressure in each cell of the zones has been reached to the pre-determined pressure. This is shown at time "b". After the pressure in each cell is stabilized, the controller 30 enables the air distributor 33 to exhaust the air from each of the first group of air cells 40 to outside. The pressure in each of the first group of air sensing chambers 315 is dropped while each of the first group of air cells 40 is deflating. When the pressure in each of the first group of air cells 40 has been reached to the pre-determined pressure, the controller 30 enables the air distributor 33 to exhaust the air from each of the second group of air cells 41 to outside. This is shown at time "c". The pressure in each of the first group of air sensing chambers 315 and each of the second group of air sensing chambers 316 is dropped while each of the second group of air cells 41 is deflating. As shown at time "d" in FIG. 14, a turning point of pressure is occurred in each of the first group of air sensing chambers 315. Such a change in pressure is monitored by the controller 30, while each of the first group of air cells 40 and the second group of air cells 41 is stopped deflating by controlling the air distributor 33. This is shown at time "e". Based on the above-described approach, the lowest therapeutic pressure Y in the alternating mode will be the pressure of each of the second group of air cells 41 at the turning point of pressure, as shown at time "d".

Figure 15:
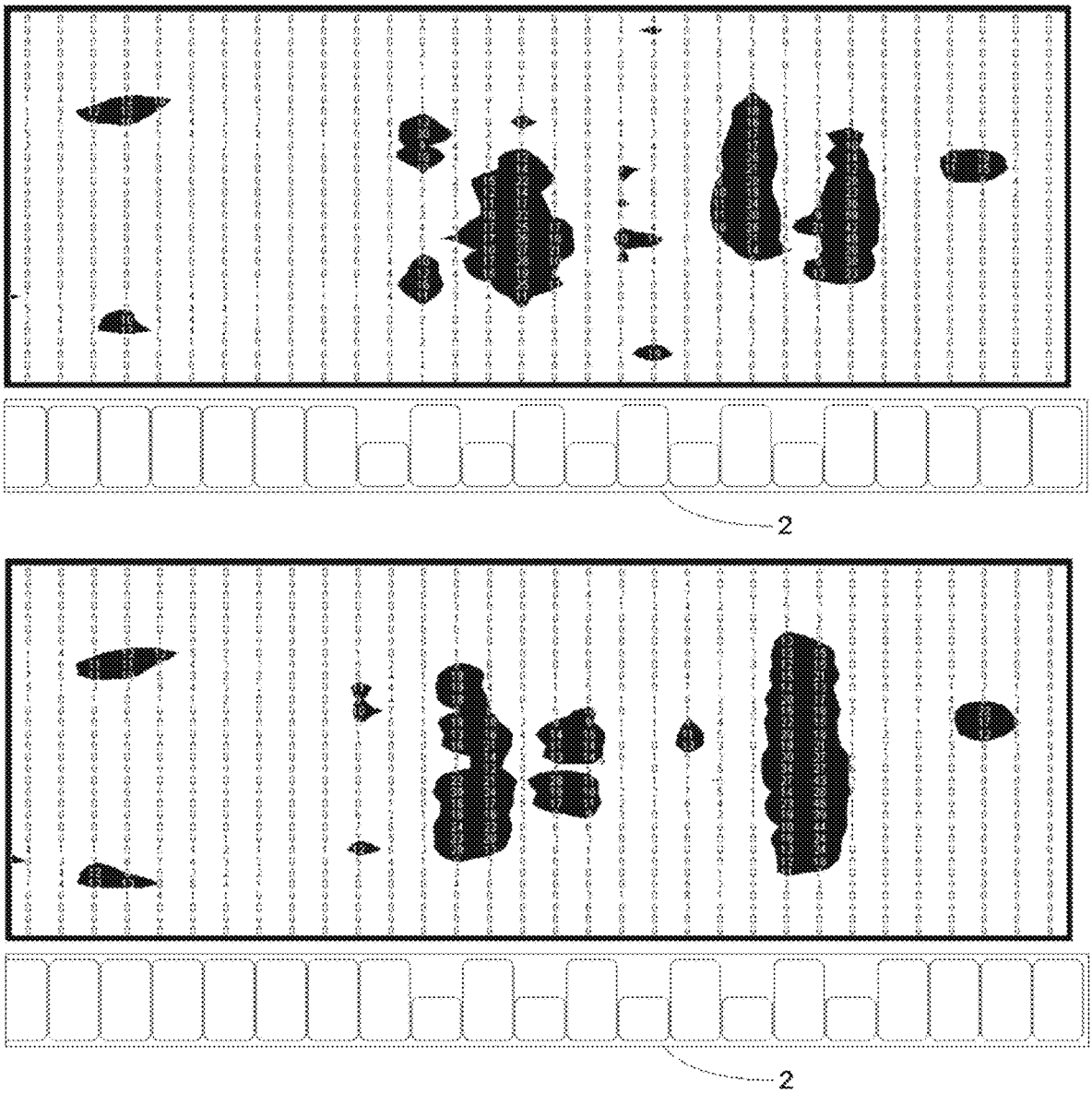
FIG. 15 illustrates an experimental result showing the values of the interface pressure between the patient and the mattress obtained by using the Innovative Pressure Mapping Solutions when the system is operating in the alternating mode and going through the auto-setting process implemented with a three-chamber structure.

FIG. 15 illustrates an experimental result showing the values of the interface pressure between the patient 39 and the mattress 2 obtained by using the Innovative Pressure Mapping Solutions when the system is operating in the alternating mode and going through the auto-setting process implemented with a three-chamber structure to determine the alternating system pressure. In FIG. 15, the experimental result indicates that the lowest therapeutic pressure Y is 33 mmHg for a male patient C of 180 cm height and 80 kg weight, and the distribution of the interface pressures between the patient and the mattress is shown. FIG. 15 also illustrates an interface pressure mapping where each of the first group of air cells 40 is inflated and each of the second group of air cells 41 is inflated. The interface pressure mapping shows that the lowest inflated supporting pressure Y yields an obvious and effective pressure relief. Therefore, it has been proved that the male patient of 180 cm tall and 80 kg weight has a therapeutic effect at the lowest therapeutic pressure Y of 33 mmHg. Therefore, the three-chamber structure implemented in the air cells of the body-section zone 37 of the mattress 2 in accordance with the present invention can be used to determine the lowest therapeutic pressure Y in the alternating mode.

Database

Figure 16:
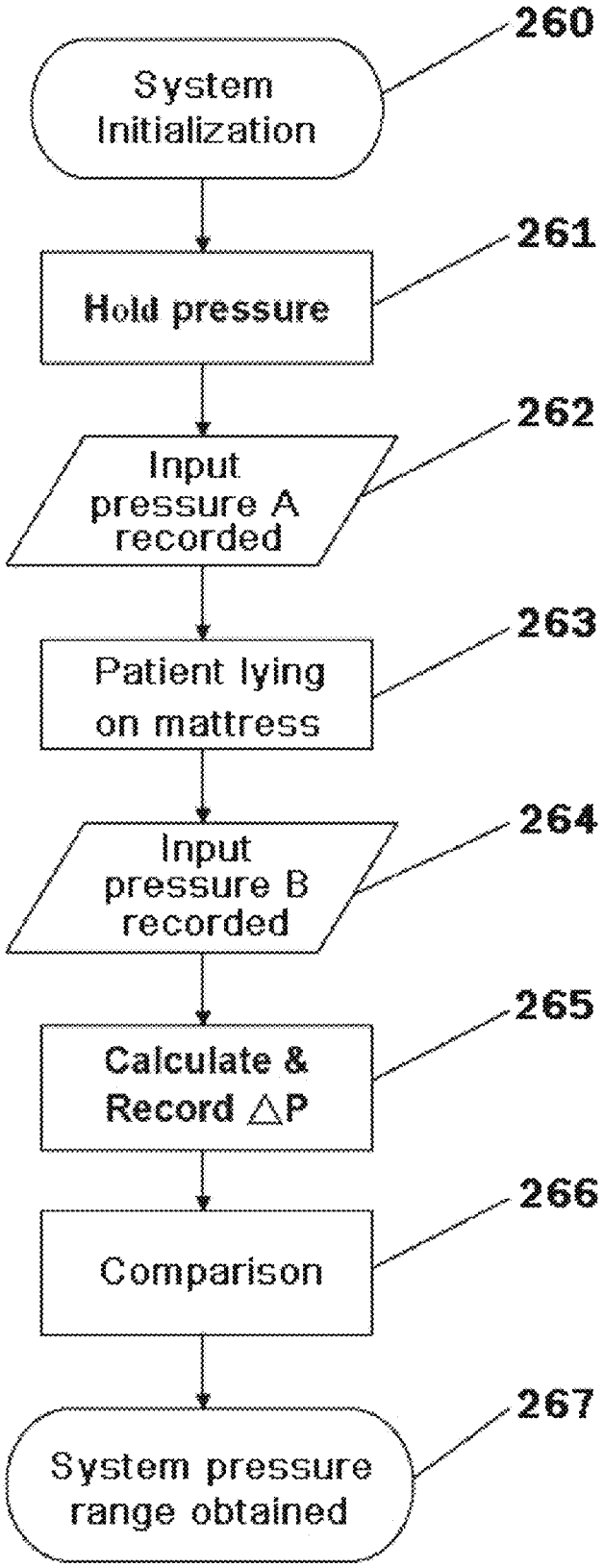
FIG. 16 is a flow chart showing the process for determining the range of values of the system pressure.

The second scheme for implementing the auto-setting process is referred to as "Database". In this scheme, the structure of the system 1 is the same as that described in the [mattress] section, and the patient will go through with a process for determining a range of values of the system pressure that can provide the therapeutic effect. FIG. 16 is a flow chart showing the process for determining the range of values of the system pressure.

In operation, with reference to FIG. 16, the mattress system 1 is initialized in step 260. Then, the compressor 32 is activated and the air distributor 33 is enabled by a signal sent from the controller 30 to inflate the pressure in each cell of the mattress 2 to a pre-determined pressure level, for example, 10 mmHg. In step 261, the compressor 32 is deactivated and all of the valves 45 in the air distributor 33 are closed to hold the pressure when the pre-determined pressure level has been reached. In step 262, the pressure in each cell of the mattress 2 is monitored by the pressure sensors 47 and recorded as a value of an input pressure A by the controller 30. Then, in step 263, the controller 30 will send a signal to the user interface so as to generate a visual and audio display thereon to indicate that the mattress 2 is ready for the patient to lie on. Since a force will be exerted on the mattress 2 when the patient is lying on the mattress 2, the pressure in each cell of the mattress 2 will be increased accordingly. After the pressure is stabilized, the increased pressure will be recorded as a value of an input pressure B by the controller 30 in step 264. Then, in step 265, a pressure difference ΔP can be obtained by subtracting the value of the recorded input pressure A from the value of the recorded input pressure B, and the value of the pressure difference ΔP is recorded as a look up index in the database indicating that the patient is in treatment. Depending on the type of the therapy mode determined by the controller 30, a corresponding actual range of values of the experimented therapeutic system pressure is compared with the data stored in a pre-programmed static database or alternating database in step 266, and then a system pressure range can be obtained in step 267. The pre-programmed static database or alternating database is a matrix table containing a series of values of the actual experimental interface pressure of the patients with respect to different values of the pressure difference ΔP, under different system pressure settings. The pre-programmed static database and the pre-programmed alternating database will be described as follows.

Figure 17:
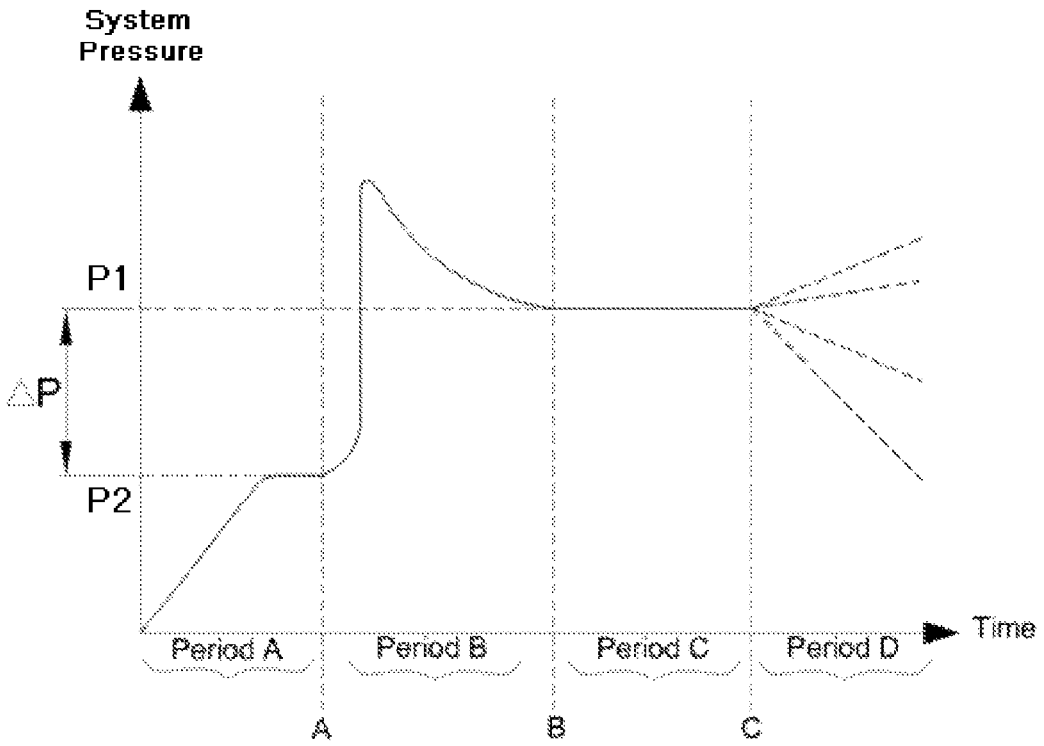
FIG. 17 is a graph showing the change of the system pressure over time in the actual operating process corresponding to the flow chart of FIG. 16.

FIG. 17 is a graph showing the change of the system pressure over time in the actual operating process corresponding to the flow chart of FIG. 16. With reference to FIG. 17, in a period A, the system 1 is initialized and the mattress 2 is inflated to a first pre-determined pressure P1. At time A, the first pre-determined pressure P1 is held and recorded as the input pressure A, and then a signal is sent by the controller 30 to indicate that the mattress 2 is ready for the patient to lie on. In a period B, the pressure in the mattress 2 starts to increase and fluctuate since the patient is lying on the mattress 2. At time B, the pressure in the mattress 2 is stabilized and the stabilized pressure P2 is recorded as the input pressure B. Next, the pressure difference ΔP is calculated during a period C. The pressure difference ΔP is then recorded and compared with the data stored in the pre-programmed static database or the pre-programmed alternating database to obtain a range of values of the therapeutic system pressure. At time C, the range of values of the system pressure is set, and the mattress 2 is inflated or deflated so that the pressure in the mattress is increased or decreased to the set system pressure range depending on the comfort level input from the user interface during a period D. Since the therapeutic system pressure in the static database or the alternating database will be presented as a range of values of the system pressure, the pressure setting can be adjusted for a better comfort level on the patient's demand.

As described in the above, the pre-programmed static database or the pre-programmed alternating database is a matrix table containing a series of values of the actual experimental interface pressure of the patients with respect to different values of the pressure difference ΔP, under different system pressure settings. It can be concluded that the value of the pressure difference ΔP will be changed when different loadings are applied on the mattress 2 in terms of different patients. Therefore, the value of the pressure difference ΔP can be used as an index representing the body characteristics of a certain patient. In FIGS. 18 and 19, the pressure difference ΔP versus the system pressure for the pre-programmed static database and the alternating database are shown.

During the experiment, the pressure difference ΔP is recorded for the patient 39. The interface pressure between the patient 39 and the mattress 2 when the patient is lying on the mattress can be measured by using a measuring device called "Innovative Pressure Mapping Solutions" manufactured by the "Vista Medical Ltd.". The system pressure of the static database or the alternating database is gradually increased in the intervals, for example, from 4 mmHg to 40 mmHg. The values of the interface pressure measured in each of these system pressure intervals are recorded in the static and alternating databases in FIGS. 18 and 19. The values of the interface pressure collected for different patients that yield a same pressure difference ΔP are then compared. The experimental results show that the same average interface pressure range can be achieved for the patients having the same pressure difference ΔP. The experimental results also show that the average values of the interface pressure increases as the values of the ΔP increases. This proves that the pressure difference ΔP can be infallibly used as an index representing the anatomy of a certain patient. In terms of the type of the therapy mode, the static database is prepared for the case that the mattress system is operating in the static mode and the alternating database is prepared for the case that the mattress system is operating in the alternating mode.

FIG. 18 shows the static database used when the system is operating in the static mode. Since the goal of the static therapy mode is to reduce the external interface pressure exerted on the patient's body, values of the average interface pressure are used and recorded as the data shown in the static database. In order to determine the range of the values of the therapeutic pressure, an upper limit 285 and a lower limit 284 of the interface pressure have to be defined in advance. From the experiment, as mentioned in the above, a lower system pressure yields a lower average interface pressure. However, the system pressure comes to a situation where it is too low such that the pressure in the mattress can no longer be sufficient to support the patient. At such a pressure level, the patient's body comes into directly contact with the bed frame, which is called "bottoming out". The lower limit 284 is set to protect the patient from being at the risk of directly contacting the bed frame, which will be occurred when the values of the system pressure fall within a bottoming-out (BO) range 286. As for the upper limit 285, in view of the clinical papers, it is true that the pressure higher than the capillary closing pressure has no therapeutic effect. Therefore, the upper limit 285 of the average interface pressure is set to 32 mmHg. The values of the interface pressure higher than the upper limit 285, which result in no therapeutic effect, are considered as in a capillary closing pressure range 288. It can be concluded that the values of the system pressure falling between the upper limit 285 and the lower limit 284 with respect to a given ΔP for a patient are in a therapeutic system pressure range 287.

Figure 20:
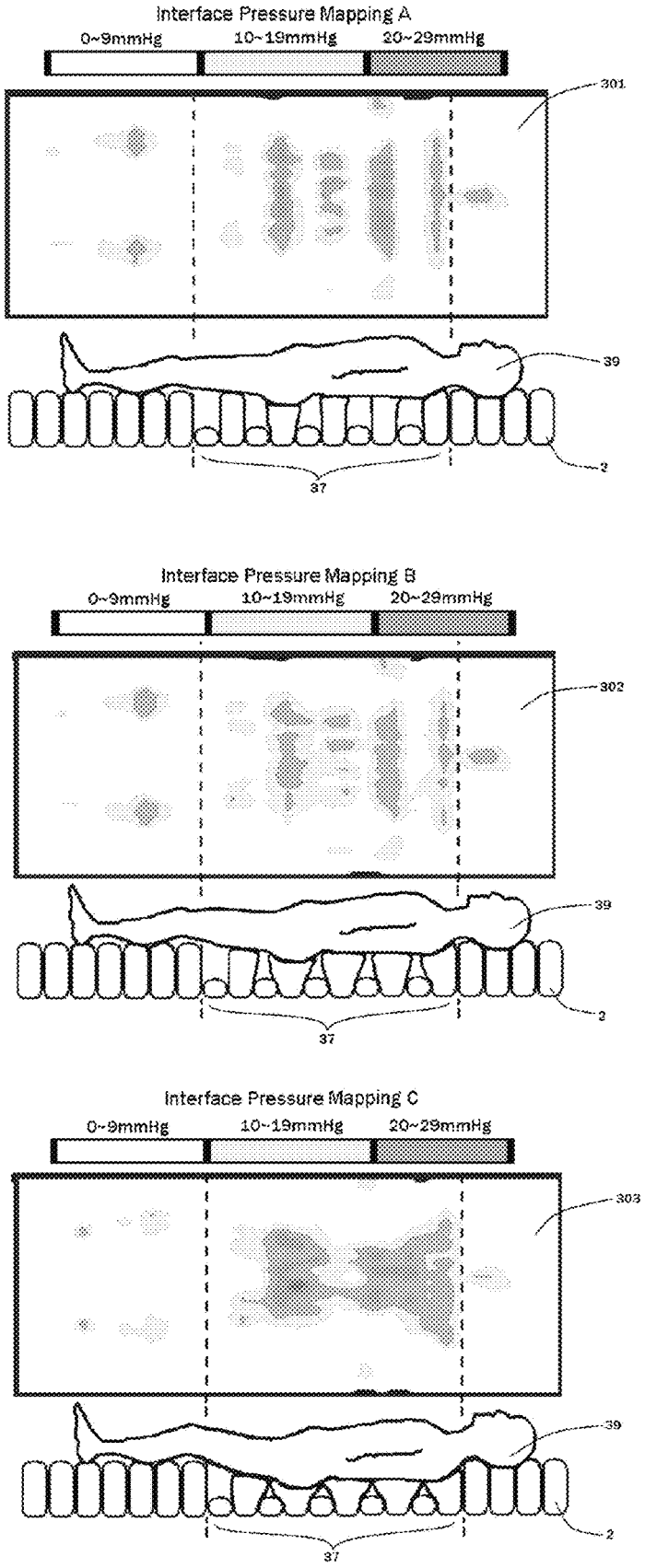
FIG. 20 illustrates mappings of the interface pressure between the patient and the mattress obtained by using Innovation Pressure Mapping Solutions to determine a lower limit for the alternating database.

FIG. 19 shows the alternating database used when the system is operating in the alternating mode, and FIG. 20 illustrates the mappings of the interface pressure between the patient and the mattress obtained by using Innovation Pressure Mapping Solutions to determine a lower limit for the alternating database. An alternating therapeutic effect can be produced by utilizing the alternating pressure to induce the reactive hyperemia as studied in the clinical paper by Johnson P. C. in 1989. The alternating pressure is obtained by cyclically bleeding off the pressure from the body-section zone 37 of the mattress 2. An alternating cycle can be started from inflating each of the first group of air cells 40 to support the patient on the mattress and deflating each of the second group of air cells 41 to induce the reactive hyperemia. Then, the inflation and deflation of the first group of air cells 40 in the mattress 2 of the system 1 are reversed after a pre-determined cycle time to induce reactive hyperemia. Since the therapeutic effect is determined by the efficiency of the pressure released in the deflated group of air cells which are called alternating zones, the therapeutic effect can be determined by the reduced interface pressure in the deflated alternating zones. Therefore, the values of the average interface pressure of the deflated zones are recorded in the alternating database. Then, an upper limit 294 and a lower limit 293 of the interface pressure are set to determine a therapeutic system pressure range 296. From the above, a higher pressure in the supporting zone gives a better reactive hyperemia to the deflation zone. Therefore, the upper limit 294 could be a pressure of 40 mmHg, which gives the support for a range of the intended patients. As for the lower limit 293, referring to FIG. 20, an interface pressure mapping A shows that at a high system pressure, there is a reduced interface pressure (no color) in the deflated zone. An interface pressure mapping C is set at a low system pressure, which is not high enough to perform a well support for the patient 39. It has shown that the interface pressure throughout the body-section zone and the pressure in the deflated zone are not released. An interface pressure mapping B shows that at a point of system pressure where partial pressure areas are observed in the deflation zone, the lower limit of the efficient pressure release. Then, the interface pressure mapping A and the interface pressure mapping B for the alternating cycles of the first group of air cells 40 and the second group of air cells 41 are compared. The lower limit 293 is then plotted in the alternating database to rule out a range having no reactive hyperemia effect 295. As in the static database, the values of the system pressure that fall between the upper limit 294 and the lower limit 293 with respect to a given ΔP for a patient are in a therapeutic system pressure range 296.

Active Coverlet for Micro-Climate Control

Under the therapy operation of mattress, the air cells in body-section zone are gone through the deflation and inflation cycles. During the deflation cycle, the deflated air is introduced into the coverlet through the air distributor 33 and the inlet ports 85 via some internal pipes 43. When the air is introduced into the coverlet, the fan 86 is activated to withdraw the air within the coverlet body 80 through the airflows 802 to outside. For the operations of the fan and the mattress shown in FIG. 9(B), the fan operation is periodically controlled by the controller 30 based on the therapy status (alternating of the two groups of air cells indicated with $P_A$ and $P_B$) and the cycle time (T). By utilizing the deflated air, the fan 86 needs not to be operated all the time to achieve an effect of removing moisture and heat. The fan 86 starts to operate from the beginning of alternating (elapsed time=0 & T/2) to a specified duration (t) in one cycle (T). In the subsequent cycles, the air flow within the coverlet body 80 is also driven by the fan 86, and the air exhausted from the air cells, and the moisture and heat are efficiently removed from the patient's body. Through the aforementioned processes, the active coverlet 70 exhibits the desired performance of the moisture and vapor transmission rate in order for the prevention or the therapy of pressure ulcers.

Sense-able CPR

The sense-able CPR is to initiate the CPR responding actions of the mattress system when the caregiver intends to perform CPR for the patient. To initiate the CPR action, the caregiver needs to open the CPR cap 91, each cushion zone will then be connected to the outside, and the air will be vented rapidly through the CPR assembly 90.

In the meantime, whether the pressure level inside the CPR sensing pipe 92 is being decreased and whether the CPR function has been performed will be detected through the pressure sensor 47 in the controller 30. Then, the compressor 32 in the control unit 3 will be turned off by the controller 30, and then all of the valves 45 will be changed to the exhaust state and the CPR indicator on the control unit 3 will be turned on.

In summary, an object of the present invention is to provide a novel mattress system comprising at least a mattress, a control unit and a connection pipe, which is simple in structure without adding other redundant components or sensing means. Among other advantages, the mattress system in accordance with the present invention removes the need to manually set the operating pressure for an alternating pressure therapy or a static pressure therapy. The mattress system in accordance with the present invention automatically sets a correct therapeutic operating pressure range for each of the patients lying on the mattress, which eliminates the need of initial setting of the operating pressure by trained operators and extends the scope of the application of the mattress system to home care and nursing care.

Therefore, from the description in the above, the mattress system 1 in accordance with the present invention can achieve at least the following merits.

(1) Since an unique user interface is provided to adjust the three system functions at the same time, the mattress system in accordance with the present invention can achieve advantages such as simple in structure, cheap in manufacturing cost, broad in the application scope, and so on.

(2) Because of an auto-setting function is particularly provided, a function of automatic detection of the body characteristics of a patient lying on the mattress can be achieved.

(3) By using the unique user interface and the auto-setting function, not only an effective therapeutic pressure support, but also an adjustable range of comfort feeling can be provided to the patient.

(4) Through the provision of a CPR assembly that can be manually switched between an exhaust state and a sealed state, the controller can detect that the air pressure in the CPR sensing pipe is decreasing, that is, the CPR assembly has been activated, each zone is opened to the external atmosphere, and the air in each zone will be exhausted rapidly through the CPR assembly.

(5) Through the provision of an active coverlet that can be covered on the mattress as an interface between the patient's body and the mattress, the efficiency of removing excessive heat and moisture from an contact surface between the patient's body and the mattress can be effectively promoted.

(6) With the integration connector, a function of easy use and thus a quick connection or disconnection between the connection pipe and the control unit can be achieved.

In consequence, as compared with the conventional mattress system for medical treatment, the present invention provides a novel mattress system, which is simple in structure without adding other redundant components or sensing means and can detect a pressure difference representing the body characteristics of the patient lying on the mattress and comparing with the data stored in the database so as to obtain a range of system pressures having an effective therapeutic effect to thereby prevent the patients suffering from pressure ulcers.

While the present invention has been described in detail and pictorially in the accompanying drawings, it is not limited to such details since many changes and modifications recognizable to those skilled in the art can be made to the invention without departing from the spirit and the scope thereof.

The invention claimed is:

1. A mattress system, comprising:

a mattress arranged for pressure supporting a patient lying on the mattress;

a plurality of air cells arranged in the mattress;

a control unit arranged to control inflation and deflation of the air cells arranged in the mattress;

a connection pipe provided between the mattress and the control unit to supply air and power;

an active coverlet provided on the mattress as an interface between a body of the patient and the mattress so as to control removal of excessive heat and moisture from a contact surface between the patient and the mattress, wherein the active coverlet includes a plurality of air pipes, an air outlet, and a coverlet body a number of air inlet ports are attached to the coverlet body and connected to an air distributor of the control unit via the plurality of air pipes such that air is exhausted from the plurality of air cells through the plurality of air pipes and distributed into the coverlet body through the air inlet ports when the mattress system is operating; and a fan assembly including an exhaust fan arranged in the air outlet for vacuuming air out of the coverlet body to external atmosphere, wherein the exhaust fan is controlled by the controller based on a therapy status and a cycle time such that once bladder layers of the mattress start to deflate, the exhaust fan starts to remove air from deflating air cells and moisture and heat from the patient; and exhausted air is discharged to the active coverlet at the same time.

2. The mattress system of claim 1, wherein the coverlet body is divided into three regions respectively corresponding to a head-section zone, a body-section zone, and a leg-section zone of the mattress.

3. The mattress system of claim 2, wherein at least one of the air inlet ports is connected to the body-section zone.

4. The mattress system of claim 1, wherein the mattress comprises an upper inflatable bladder layer, a lower inflatable bladder layer positioned under the upper inflatable bladder layer, and a plurality of air cells each having an upper portion located in the upper inflatable bladder layer and a lower portion located in the lower inflatable bladder layer.

5. The mattress system of claim 4, wherein the plurality of air cells are arranged in a longitudinal direction and separated into a plurality of zones, and air cells in each zone are fluidly interconnected with each other.

6. The mattress system of claim 5, wherein the plurality of air cells in the upper inflatable bladder layer are separated into a head-section zone, a body-section zone, and a leg-section zone.

7. The mattress system of claim 6, wherein the coverlet body in a region corresponding to the body-section zone of the mattress includes a top layer, a middle layer and a bottom layer so as to transfer moisture and heat from the patient to outside.

8. The mattress system of claim 7, wherein the top layer is water impermeable and vapor permeable, the middle layer is water permeable and vapor permeable, and the bottom layer is water impermeable and vapor impermeable and isolates moisture from air cells of the body-section zone of the mattress.

9. The mattress system of claim 7, wherein the middle layer has a three-dimensional porous structure that is placed within an enclosure as an air channel, thereby enabling air to flow within the enclosure, and that is elastic under compression.

10. The mattress system of claim 1, wherein the control unit includes a user interface that enables a caregiver to simultaneously adjust mattress system functions, and a controller that is programmed with an auto-setting process to sense body characteristics of the patient and determine a therapeutic effective supporting pressure range to support the patient on the mattress, thereby providing therapeutic pressure support and an adjustable range of comfort through a combination of the user interface and the auto-setting process.

11. The mattress system of claim 10, wherein the auto-setting process is implemented by air cells having a three-chamber structure in a body-section zone, each three-chamber air cell comprises an upper bladder chamber, an air sensing chamber, and a lower bladder chamber, with the air sensing chamber positioned at a bottom portion of the upper bladder chamber.

12. The mattress system of claim 11, wherein the three-chamber air cells in the body-section zone enable detecting a lowest therapeutic pressure of the upper bladder chamber in a static therapy mode.

13. The mattress system of claim 10, wherein the auto-setting process is implemented by using pre-programmed databases including a static database containing values of actual experimental interface pressure of patients with respect to different values of pressure difference under different system pressure settings.

14. A mattress system, comprising:

a mattress arranged for pressure supporting a patient lying on the mattress;

a plurality of air cells arranged in the mattress;

a control unit arranged to control inflation and deflation of the air cells arranged in the mattress;

a connection pipe provided between the mattress and the control unit to supply air and power; and an active coverlet provided on the mattress as an interface between a body of the patient and the mattress so as to control removal of excessive heat and moisture from a contact surface between the patient and the mattress, wherein the active coverlet includes a plurality of air pipes, an air outlet, and a coverlet body a number of air inlet ports are attached to the coverlet body and connected to an air distributor of the control unit via the plurality of air pipes such that air is exhausted from the plurality of air cells through the plurality of air pipes and distributed into the coverlet body through the air inlet ports when the mattress system is operating, wherein the control unit includes a user interface that enables a caregiver to simultaneously adjust mattress system functions, and a controller that is programmed with an auto-setting process to sense body characteristics of the patient and determine a therapeutic effective supporting pressure range to support the patient on the mattress, thereby providing therapeutic pressure support and an adjustable range of comfort through a combination of the user interface and the auto-setting process, and wherein the auto-setting process is implemented by air cells having a three-chamber structure in a body-section zone, each three-chamber air cell comprises an upper bladder chamber, an air sensing chamber, and a lower bladder chamber, with the air sensing chamber positioned at a bottom portion of the upper bladder chamber.

15. The mattress system of claim 14, wherein the three-chamber air cells in the body-section zone enable detecting a lowest therapeutic pressure of the upper bladder chamber in a static therapy mode.

* * * * *